US010941769B2

(12) United States Patent
Teshima et al.

(10) Patent No.: US 10,941,769 B2
(45) Date of Patent: Mar. 9, 2021

(54) SCROLL COMPRESSOR WITH BACK PRESSURE CONTROL VALVE

(71) Applicant: SANDEN HOLDINGS CORPORATION, Isesaki (JP)

(72) Inventors: Atsuo Teshima, Isesaki (JP); Yoshio Kowada, Isesaki (JP); Hiroshi Honda, Isesaki (JP); Yoshinobu Maemura, Isesaki (JP); Misako Kaburagi, Isesaki (JP)

(73) Assignee: SANDEN HOLDINGS CORPORATION, Gunma (JP)

( * ) Notice: Subject to any disclaimer, the term of this patent is extended or adjusted under 35 U.S.C. 154(b) by 230 days.

(21) Appl. No.: 16/323,221

(22) PCT Filed: Jul. 6, 2017

(86) PCT No.: PCT/JP2017/024817
§ 371 (c)(1),
(2) Date: Feb. 4, 2019

(87) PCT Pub. No.: WO2018/025569
PCT Pub. Date: Feb. 8, 2018

(65) Prior Publication Data

US 2019/0211828 A1 Jul. 11, 2019

(30) Foreign Application Priority Data

Aug. 4, 2016 (JP) ..... JP2016-153519

(51) Int. Cl.
*F04C 18/02* (2006.01)
*F04C 29/12* (2006.01)

(52) U.S. Cl.
CPC ..... *F04C 18/0215* (2013.01); *F04C 29/12* (2013.01); *F04C 29/124* (2013.01); *F04C 2240/80* (2013.01); *F04C 2270/185* (2013.01)

(58) Field of Classification Search
CPC ..... F04C 18/0215; F04C 2240/80; F04C 2270/185
See application file for complete search history.

(56) References Cited

U.S. PATENT DOCUMENTS 10,502,211 B2 * 12/2019 Nagahara ..... F04C 18/0215
2015/0098852 A1 4/2015 Kim et al.
2016/0186754 A1 * 6/2016 Cho ..... F04C 18/0215 418/55.1

FOREIGN PATENT DOCUMENTS

JP 2-294584 12/1990
JP 8-303371 11/1996
(Continued)

*Primary Examiner* — Mary Davis
(74) *Attorney, Agent, or Firm* — Cozen O'Connor

(57) ABSTRACT

An object is to optimize a back pressure pressing an orbiting scroll against a fixed scroll in a scroll compressor to which an injection cycle is applied. A back pressure control valve (400) adjusting back pressure (Pm) in a back pressure chamber (H4), adjusts the opening degree of a first valve body (424) increasing and decreasing the flow rate of lubricant which has been separated from gaseous refrigerant compressed in a compression chamber and is supplied to the back pressure chamber (H4), in accordance with suction pressure (Ps) in a suction chamber (H1), discharge pressure (Pd) in a discharge chamber (H2), and injection pressure (Pinj). Then, the back pressure control valve (400) increases and decreases the lubricant flow rate in accordance with injection pressure (Pinj) as well as suction pressure (Ps) and discharge pressure (Pd), to adjust back pressure to target back pressure varying in accordance with injection pressure (Pinj).

7 Claims, 20 Drawing Sheets

(56) References Cited

FOREIGN PATENT DOCUMENTS

| | | | | |
|---|---|---|---|---|
| JP | 2018204532 A | * | 12/2018 | ..... F04C 18/02 |
| WO | WO 2012/147145 | | 11/2012 | |

* cited by examiner

SCROLL COMPRESSOR WITH BACK PRESSURE CONTROL VALVE

RELATED APPLICATIONS

This is a U.S. National Phase Application under 35 USC 371 of International Application PCT/JP2017/024817 filed on Jul. 6, 2017.

This application claims the priority of Japanese application no. 2016-153519 filed Aug. 4, 2016, the entire content of which is hereby incorporated by reference.

TECHNICAL FIELD

The present invention relates to a scroll compressor that compresses refrigerant in a refrigeration cycle.

BACKGROUND ART

A scroll compressor is provided with a scroll unit including a fixed scroll and an orbiting scroll engaged with each other. In the scroll unit, by causing the orbiting scroll to revolve around the axis of the fixed scroll, the capacity of a compression chamber defined by the fixed and orbiting scrolls increases and decreases to compress and discharge gaseous refrigerant. In the scroll compressor, a back pressure is applied to the back of the orbiting scroll to press the orbiting scroll against the fixed scroll. This prevents the orbiting scroll from departing from the fixed scroll during a compression operation, resulting in decrease in occurrence of insufficient compression. Here, the back pressure applied to the back of the orbiting scroll is adjusted based on a suction pressure and a discharge pressure of the gaseous refrigerant, as disclosed in WO2012/147145 (Patent Document 1).

REFERENCE DOCUMENT LIST

Patent Documents

Patent Document 1: WO2012/147145

SUMMARY OF THE INVENTION

Problem to be Solved by the Invention

In recent years, in order to improve the coefficient of performance (COP), a scroll compressor to which a gas injection cycle is applied has been put to practical use. In the gas injection cycle, a refrigeration effect is improved by injecting gaseous refrigerant separated by a gas-liquid separator into a compression chamber of the compressor in a refrigerant circuit in which the compressor, a condenser, a first expansion valve, the gas-liquid separator, a second expansion valve, and an evaporator are arranged in this order.

However, in such a scroll compressor to which such a gas injection cycle is applied, since gaseous refrigerant is injected into the compression chamber, a target back pressure varies in accordance with the pressure of the gaseous refrigerant injected into the compression chamber (injection pressure). Specifically, when the injection pressure is high, there is a concern that the back pressure may be insufficient and a force pressing the orbiting scroll against the fixed scroll may become weak, resulting in leakage of gaseous refrigerant from the compression chamber and decrease in compression efficiency, for example. In contrast, when the injection pressure is low, there is a concern that the back pressure may be excessive, so that, for example, a drive force making the orbiting scroll revolve increases, resulting in decrease in compression efficiency, galling of wraps of the scrolls, and the like.

Thus, an object of the present invention is to optimize the back pressure in the scroll compressor to which the injection cycle is applied.

Means for Solving the Problem

Thus, the scroll compressor comprises:

a scroll unit that increases and decreases a capacity of a compression chamber defined by a fixed scroll and an orbiting scroll, and injects a gaseous refrigerant which has been taken out from the middle of a refrigerant circuit, into the compression chamber, to draw in, compress and discharge the gaseous refrigerant; and a back pressure control valve that adjusts a pressure in a back pressure chamber that presses the orbiting scroll against the fixed scroll, in accordance with a suction pressure of the gaseous refrigerant drawn into the compression chamber, a discharge pressure of the gaseous refrigerant discharged from the compression chamber, and an injection pressure of the gaseous refrigerant injected into the compression chamber.

Effects of the Invention

According to the present invention, it is possible to optimize the back pressure in the scroll compressor to which the injection cycle is applied.

MODE FOR CARRYING OUT THE INVENTION

Hereinbelow, embodiments for carrying out of the present invention will be described in detail with reference to the accompanying drawings.

Figure 1:
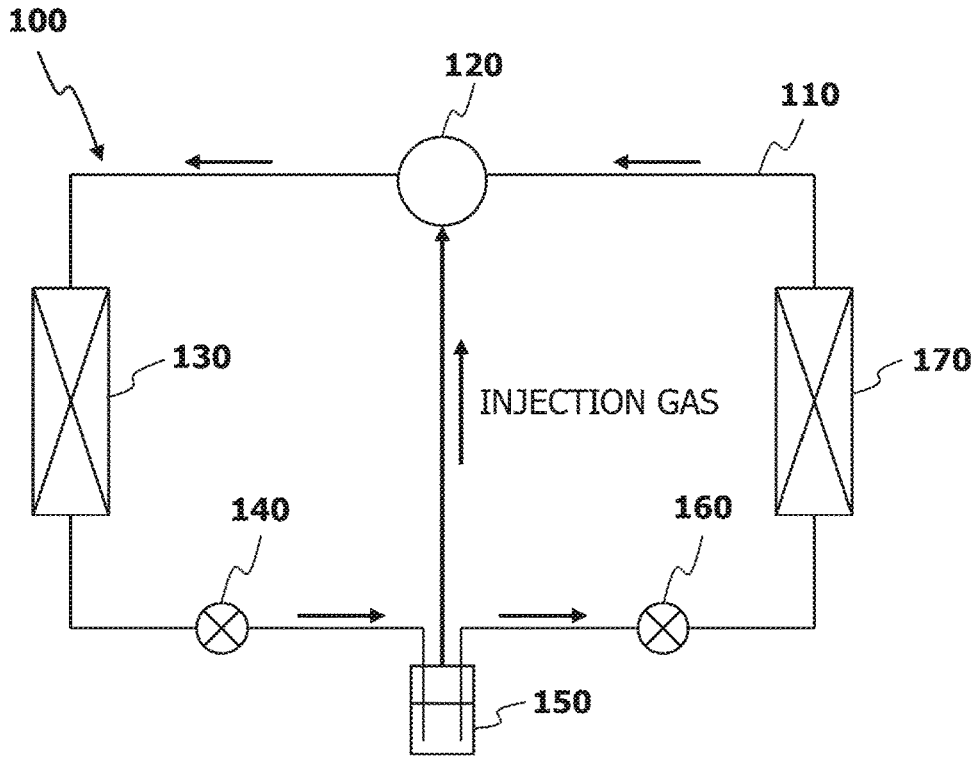
FIG. 1 is a schematic view of a refrigeration cycle to which a gas injection cycle is applied.

FIG. 1 illustrates an example of a refrigeration cycle 100 to which a gas injection cycle is applied, which is a premise of the present embodiment. Here, the refrigeration cycle 100 is given as an example of the refrigerant circuit.

The refrigeration cycle 100 is configured by providing a refrigerant passage 110 through which refrigerant circulates, with a compressor 120, a condenser 130, a first expansion valve 140, a gas-liquid separator 150, a second expansion valve 160 and an evaporator 170 arranged in this order. The compressor 120 compresses a low temperature, low pressure gaseous refrigerant into a high temperature, high pressure gaseous refrigerant. The condenser 130 cools the high temperature, high pressure gaseous refrigerant, which has passed through the compressor 120, into a high pressure, low temperature liquid refrigerant. The first and second expansion valves 140, 160 decompress the low temperature, high pressure liquid refrigerant in two stages into a low temperature, low pressure liquid refrigerant. The evaporator 170 vaporizes the low temperature, low pressure liquid refrigerant into a low temperature, low pressure gaseous refrigerant. Furthermore, the gas-liquid separator 150 separates a gaseous refrigerant from an intermediate pressure liquid refrigerant decompressed by the first expansion valve 140, and supplies the obtained gaseous refrigerant to the compressor 120 as an injection gas.

Figure 2:
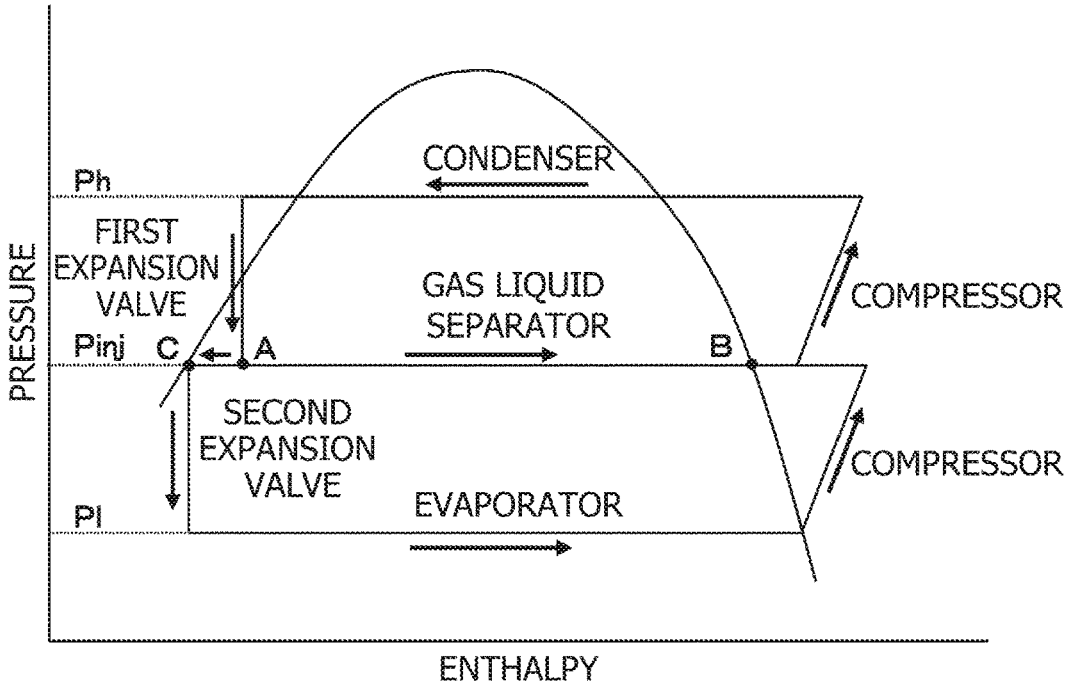
FIG. 2 is a Mollier diagram of the gas injection cycle.

FIG. 2 is a Mollier diagram of the gas injection cycle.

The liquid refrigerant at high pressure Ph, which has passed through the condenser 130, is decompressed by the first expansion valve 140 to injection pressure Pinj, which is an intermediate pressure, yielding a gas-liquid two phase refrigerant. The resultant is introduced into the gas-liquid separator 150. In the gas-liquid separator 150, point A represents a state of the introduced refrigerant at an inlet, and the refrigerant is separated into a saturated gaseous refrigerant given by point B and a saturated liquid refrigerant given by point C inside the gas-liquid separator 150. Thereafter, the saturated liquid refrigerant is further decompressed by the second expansion valve 160 to low pressure P1, and then, the resultant is introduced into the evaporator 170. In the evaporator 170, the liquid refrigerant at low pressure P1 is vaporized into a gaseous refrigerant by allowing heat exchange with outside air, and the resultant is introduced into the compressor 120. On the other hand, the saturated gaseous refrigerant at injection pressure Pinj is injected into a compression chamber of the compressor 120.

Next, as an example of the compressor 120 that constitutes the gas injection cycle, a scroll compressor 200 that compresses gaseous refrigerant by a fixed scroll and an orbiting scroll will be described.

Figure 3:
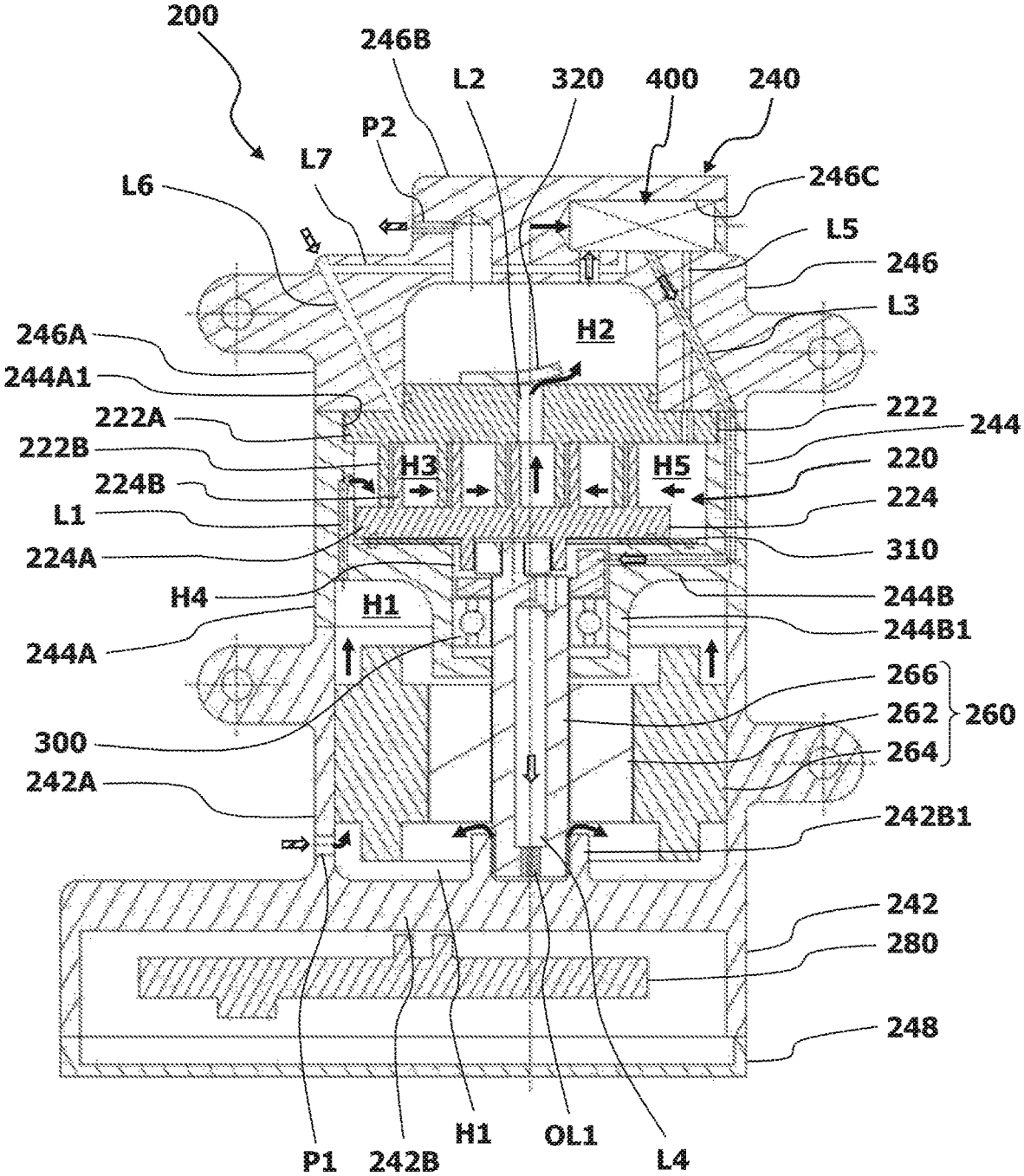
FIG. 3 is a cross-sectional view illustrating an example of a scroll compressor.

FIG. 3 illustrates an example of the scroll compressor 200.

The scroll compressor 200 includes a scroll unit 220, a housing 240 having a suction chamber H1 and a discharge chamber H2 for gaseous refrigerant, an electric motor 260 that functions as a driving unit for driving the scroll unit 220, and an inverter 280 for controlling the drive of the electric motor 260. The inverter 280 may be provided without being incorporated in the scroll compressor 200.

The scroll unit 220 has a fixed scroll 222 and an orbiting scroll 224 engaged with each other. The fixed scroll 222 includes a disk-shaped base plate 222A and an involute-shaped (spiral-shaped) wrap 222B that is erect on a face of the base plate 222A. Similarly to the fixed scroll 222, the orbiting scroll 224 includes a disk-shaped base plate 224A and an involute-shaped wrap 224B that is erect on a face of the base plate 224A.

The fixed scroll 222 and the orbiting scroll 224 are arranged such that the wraps 222B and 224B are engaged with each other. Specifically, they are arranged such that a tip portion of the wrap 222B of the fixed scroll 222 contacts a face of the base plate 224A of the orbiting scroll 224, and a tip portion of the wrap 224B of the orbiting scroll 224 contacts a face of the base plate 222A of the fixed scroll 222. To each of the tip portions of the wraps 222B and 224B, a tip seal (not illustrated) is attached.

Furthermore, the fixed scroll 222 and the orbiting scroll 224 are arranged such that side walls of the wraps 222B and 224B partially contact each other in a state in which the angles of the wraps 222B and 224B in the circumferential direction are shifted from each other. Thus, between the wrap 222B of the fixed scroll 222 and the wrap 224B of the orbiting scroll 224, a crescent-shaped enclosed space that functions as a compression chamber H3 is formed.

The orbiting scroll 224 is disposed in a manner capable of revolving around the axis of the fixed scroll 222 via a crank mechanism described below in a state in which rotation of the orbiting scroll 224 is restricted. Thus, the scroll unit 220 moves the compression chamber H3 defined by the wrap 222B of the fixed scroll 222 and the wrap 224B of the orbiting scroll 224 to the central portion to gradually reduce the capacity of the compression chamber H3. Accordingly, the scroll unit 220 compresses gaseous refrigerant drawn into the compression chamber H3 from outer end portions of the wraps 222B and 224B.

The housing 240 includes a front housing 242 that accommodates the electric motor 260 and the inverter 280, a center housing 244 that accommodates the scroll unit 220, a rear housing 246, and an inverter cover 248. The front housing 242, the center housing 244, the rear housing 246 and the inverter cover 248 are integrally fastened with fasteners (not illustrated), such as bolts and washers, to constitute the housing 240 of the scroll compressor 200.

The front housing 242 includes a peripheral wall 242A having an approximately tubular shape and a partition wall 242B. The inner space of the front housing 242 is partitioned by the partition wall 242B into a space for accommodating the electric motor 260 and a space for accommodating the inverter 280. An opening of the peripheral wall 242A at one end side (lower end in FIG. 3) is closed with the inverter cover 248. An opening of the peripheral wall 242A at the other end side (upper end in FIG. 3) is closed with the center housing 244. The partition wall 242B has, at its radially central portion, a substantially tubular support portion 242B1 that rotatably supports one end portion of a drive shaft 266 described below, the support portion 242B1 protruding toward the other end side of the peripheral wall 242A.

Furthermore, the suction chamber H1 for gaseous refrigerant is defined by the peripheral wall 242A and partition wall 242B of the front housing 242, and the center housing 244. Into the suction chamber H1, a low pressure, low temperature gaseous refrigerant is drawn via a suction port P1 formed through the peripheral wall 242A. In the suction chamber H1, gaseous refrigerant flows around the electric motor 260 to enable cooling of the electric motor 260, and accordingly, spaces above and below the electric motor 260 communicate with each other to form the single suction chamber H1. In the suction chamber H1, an appropriate amount of a lubricant is held to lubricate sliding portions, such as the drive shaft 266 that is driven to rotate. Thus, in the suction chamber H1, gaseous refrigerant flows as a mixed fluid in which the gaseous refrigerant and the lubricant are mixed.

The center housing 244 has a substantially tubular shape with a bottom and has an opening at the opposite side to the side at which the front housing 242 is fastened. The center housing 244 can accommodate thereinside the scroll unit 220. The center housing 244 has a tubular portion 244A and a bottom wall 244B at one end side of the tubular portion 244A. In a space defined by the tubular portion 244A and the bottom wall 244B, the scroll unit 220 is accommodated. At the other end side of the tubular portion 244A, a fit portion 244A1 to which the fixed scroll 222 is fit is formed. Thus, the opening of the center housing 244 is closed with the fixed scroll 222. Furthermore, the bottom wall 244B is formed to bulge out toward the electric motor 260 at its radially central portion. A through hole, through which the other end portion of the drive shaft 266 penetrates, is formed through this bulge portion 244B1 of the bottom wall 244B at its radially central portion. At the side of the scroll unit 220 of the bulge portion 244B1, a fit portion to which a bearing 300 that rotatably supports the other end portion of the drive shaft 266 is formed.

Between the bottom wall 244B of the center housing 244 and the base plate 224A of the orbiting scroll 224, an annular thrust plate 310 is disposed. An outer peripheral portion of the bottom wall 244B receives a thrust force from the orbiting scroll 224 via the thrust plate 310. In each portion of the bottom wall 244B and the base plate 224A, that contacts the thrust plate 310, a seal member (not illustrated) is buried.

Furthermore, between an end face of the base plate 224A at the side of the electric motor 260 and the bottom wall 244B, that is, between the end face of the orbiting scroll 224 at the opposite side to the fixed scroll 222 and the center housing 244, a back pressure chamber H4 is formed. In the center housing 244, there is formed a refrigerant introduction passage L1 for introducing gaseous refrigerant (specifically, mixed fluid of gaseous refrigerant and lubricant) from the suction chamber H1 to a space H5 near the outer end portions of the wraps 222B and 224B of the scroll unit 220. Since the refrigerant introduction passage L1 communicates between the space H5 and the suction chamber H1, the pressure in the space H5 is equal to the pressure in the suction chamber H1 (suction pressure Ps).

The rear housing 246 is fastened to an end portion of the tubular portion 244A of the center housing 244 at the side of the fit portion 244A1 with a fastener. Thus, the fixed scroll 222 is secured such that the base plate 222A thereof is held between the fit portion 244A1 and the rear housing 246. Furthermore, the rear housing 246 has a substantially tubular shape with a bottom and has an opening at the side at which the rear housing 246 is fastened to the center housing 244. The rear housing 246 has a tubular portion 246A and a bottom wall 246B at the other end side of the tubular portion 246A.

The tubular portion 246A and bottom wall 246B of the rear housing 246 and the base plate 222A of the fixed scroll 222 define the discharge chamber H2 for gaseous refrigerant. At the central portion of the base plate 222A, a discharge passage (discharging hole) L2 for compressed refrigerant is formed. The discharge passage L2 is provided with a check valve 320 that regulates a flow from the discharge chamber H2 to the scroll unit 220, the check valve 320 being constituted by a reed valve, for example. Into the discharge chamber H2, compressed refrigerant compressed in the compression chamber H3 of the scroll unit 220 is discharged via the discharge passage L2 and the check valve 320. The compressed refrigerant in the discharge chamber H2 is discharged into the condenser 130 via a discharge port P2 formed in the bottom wall 246B.

Although not illustrated, an oil separator for separating a lubricant from the compressed refrigerant in the discharge chamber H2 is disposed in the rear housing 246. The compressed refrigerant from which the lubricant has been separated by the oil separator (the refrigerant may contain a trace amount of lubricant) is discharged into the condenser 130 via the discharge port P2. On the other hand, the lubricant separated by the oil separator is introduced into a pressure supply passage L3 described below. In FIG. 3, flows of gaseous refrigerant before or after being mixed with lubricant are indicated by arrows with the hatch pattern, flows of gaseous refrigerant mixed with lubricant (mixed fluid) are indicated by solid arrows, and flows of lubricant separated from gaseous refrigerant are indicated by open arrows. Here, the pressure supply passage L3 is given as an example of a passage through which lubricant is supplied to the back pressure chamber.

For example, the electric motor 260 is constituted by a three-phase alternating-current motor, and has a rotor 262, and a stator core unit 264 disposed outside the rotor 262 in the radial direction. For example, a direct current from an on-board battery (not illustrated) is converted to an alternating current by the inverter 280, and the alternating current is supplied to the electric motor 260.

The rotor 262 is rotatably supported inside the stator core unit 264 in the radial direction via the drive shaft 266 press-fitted in a shaft hole formed at the radial center of the rotor 262. One end portion of the drive shaft 266 is rotatably supported by the support portion 242B1 of the front housing 242. The other end portion of the drive shaft 266 penetrates through the through-hole formed in the center housing 244 and is rotatably supported by the bearing 300. When power is supplied from the inverter 280 and a magnetic field is generated in the stator core unit 264, a rotational force is applied to the rotor 262 and the drive shaft 266 is driven to rotate. The other end portion of the drive shaft 266 is connected to the orbiting scroll 224 via the crank mechanism.

Figure 4:
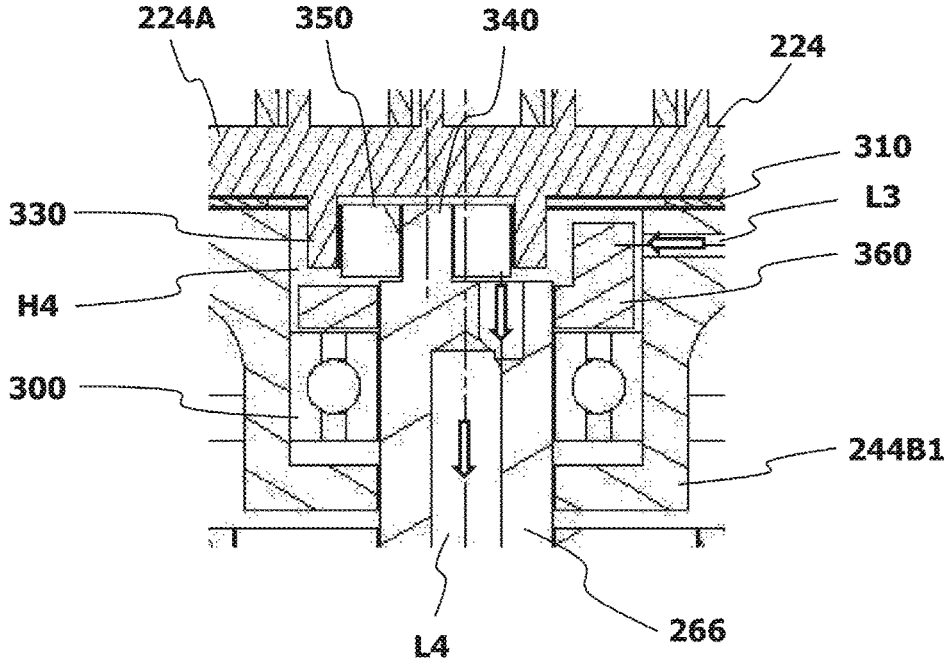
FIG. 4 is a partial enlarged view illustrating details of a crank mechanism

As illustrated in FIG. 4, the crank mechanism includes a tubular boss 330 formed to protrude from the back pressure chamber H4-side end face of the base plate 224A of the orbiting scroll 224, and an eccentric bush 350 attached in an eccentric state to a crank 340 provided on the other end portion of the drive shaft 266. The eccentric bush 350 is rotatably supported by the boss 330. To the other end portion of the drive shaft 266 (end portion on the side of the crank 340), there is attached a balance weight 360 that opposes the centrifugal force generated when the orbiting scroll 224 is operated. Thus, the orbiting scroll 224 is capable of revolving around the axis of the fixed scroll 222 via the crank mechanism in a state in which rotation of the orbiting scroll 224 is restricted.

Figure 5:
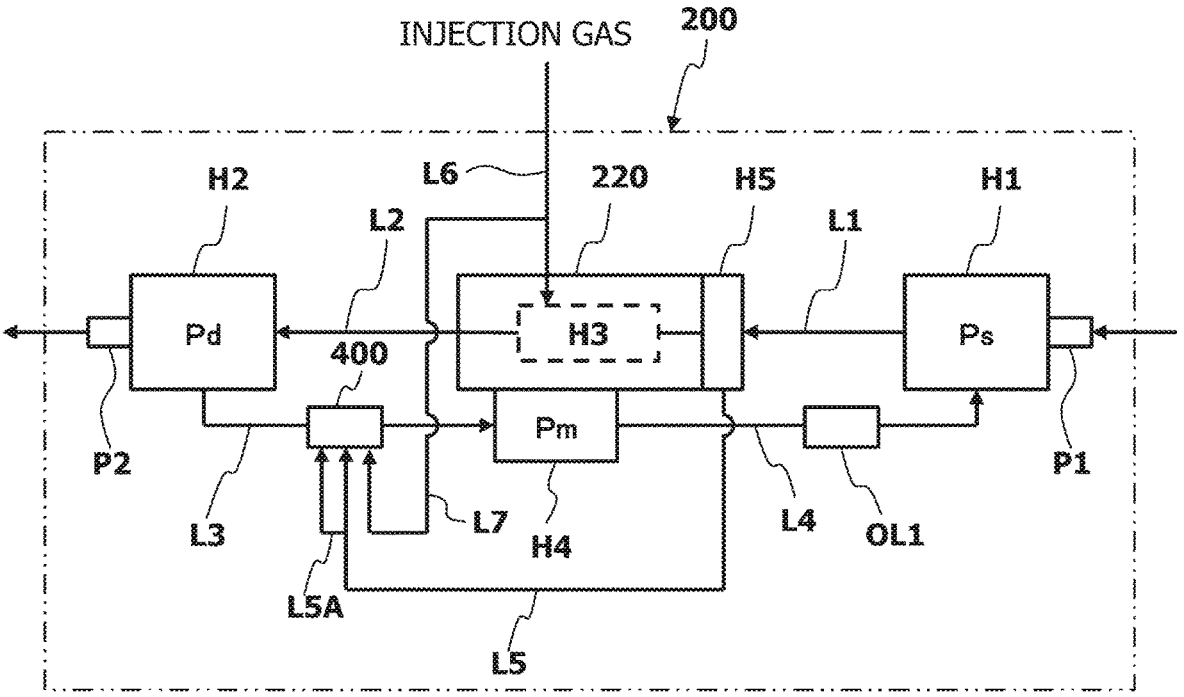
FIG. 5 is a block diagram for explaining a flow of gaseous refrigerant.

FIG. 5 is a block diagram for explaining a flow of gaseous refrigerant in the scroll compressor 200.

As illustrated in FIGS. 3 and 5, a low pressure, low temperature gaseous refrigerant from the evaporator 170 is introduced into the suction chamber H1 via the suction port P1, and thereafter, the refrigerant is introduced to the space H5 near the outer end portion of the scroll unit 220 via the refrigerant introduction passage L1. Then, the gaseous refrigerant in the space H5 is drawn into the compression chamber H3 of the scroll unit 220 and is compressed. The compressed refrigerant compressed in the compression chamber H3 is discharged into the discharge chamber H2 via the discharge passage L2 and the check valve 320, and thereafter, the refrigerant is discharged from the discharge chamber H2 into the condenser 130 via the discharge port P2. This constitutes the scroll unit 220 in which gaseous refrigerant drawn in via the suction chamber H1 is compressed in the compression chamber H3, and the compressed refrigerant is discharged via the discharge chamber H2.

Here, as illustrated in FIG. 3, the scroll compressor 200 further includes a back pressure control valve 400 for adjusting the pressure in the back pressure chamber H4.

The back pressure control valve 400 is a mechanical (autonomous) flow control valve that operates in accordance with suction pressure Ps in the suction chamber H1, discharge pressure Pd in the discharge chamber H2, and injection pressure Pinj, so as to automatically adjust its valve opening degree such that back pressure Pm in the back pressure chamber H4 approaches a target back pressure Pc set in accordance with suction pressure Ps, discharge pressure Pd and injection pressure Pinj. In the bottom wall 246B of the rear housing 246, the back pressure control valve 400 is accommodated in an accommodation chamber 246C formed to extend in a direction orthogonal to the axis of the drive shaft 266 of the electric motor 260. The structure and the back pressure adjustment operation of the back pressure control valve 400 will be described below.

As illustrated in FIGS. 3 and 5, in addition to the refrigerant introduction passage L1 and the discharge passage L2, the scroll compressor 200 includes the pressure supply passage L3, a pressure release passage L4, a suction pressure sensing passage L5, an injection gas introduction passage L6 and an injection pressure sensing passage L7. Here, the pressure release passage L4 is given as an example of a passage through which lubricant is discharged from the back pressure chamber.

The pressure supply passage L3 is a passage that communicates between the discharge chamber H2 and the back pressure chamber H4. The lubricant separated from the compressed refrigerant in the discharge chamber H2 by the oil separator is introduced into the back pressure chamber H4 via the pressure supply passage L3, and is used for lubrication of each sliding portion. Furthermore, supplying the lubricant to the back pressure chamber H4 via the pressure supply passage L3 increases back pressure Pm in the back pressure chamber H4.

Specifically, the pressure supply passage L3 includes: a passage that communicates between the discharge chamber H2 and the accommodation chamber 246C; a passage having one end that is open to the accommodation chamber 246C and the other end that is open at an end face portion of the tubular portion 246A of the rear housing 246, the end face portion contacting the center housing 244; and a passage that connects to the latter passage and that penetrates through the tubular portion 244A and bottom wall 244B of the center housing 244 and is open to the back pressure chamber H4.

The back pressure control valve 400 is provided along the pressure supply passage L3 so as to constitute a part of the pressure supply passage L3. Thus, the lubricant separated from the compressed refrigerant in the discharge chamber H2 is appropriately decompressed by the back pressure control valve 400, and is supplied to the back pressure chamber H4 via the pressure supply passage L3. That is, adjusting the opening degree of the pressure supply passage L3 connected to the back pressure chamber H4 at the inlet side (upstream side) by the back pressure control valve 400, increases and decreases the flow rate of lubricant flowing in the back pressure chamber H4 to adjust back pressure Pm.

The pressure release passage L4 is a passage that communicates between the back pressure chamber H4 and the suction chamber H1. An orifice OL1 is provided along the pressure release passage L4. Furthermore, the pressure release passage L4 in which the orifice OL1 is provided is formed to penetrate the drive shaft 266 and extends along the axis of the drive shaft 266. For example, the orifice OL1 is provided at the end portion of the drive shaft 266 at the side of the suction chamber H1 (in FIG. 3, at the side of the support portion 242B1 of the front housing 242). The lubricant in the back pressure chamber H4 is made to return to the suction chamber H1 with the flow rate restricted by the orifice OLE The suction pressure sensing passage L5 is a passage for sensing suction pressure Ps in the suction chamber H1 in the back pressure control valve 400. The suction pressure sensing passage L5 includes: a passage having one end that is open to the accommodation chamber 246C and the other end that is open at an end face portion of the tubular portion 246A of the rear housing 246, the end face portion contacting the fixed scroll 222; and a passage that is connected to the former passage and that penetrates through the outer peripheral portion of the base plate 222A of the fixed scroll 222 and is open to the space H5. Furthermore, as illustrated in FIG. 5, there is formed a suction pressure sensing branch passage L5A that branches from the suction pressure sensing passage L5 at a predetermined site and is open to the bottom of the accommodation chamber 246C. In FIG. 3, the suction pressure sensing branch passage L5A is not shown to simplify the drawing. Furthermore, although the suction pressure sensing passage L5 will be described with an example in which the suction pressure sensing passage L5 is open to the space H5, the suction pressure sensing passage L5 may be directly open to the suction chamber H1.

The injection gas introduction passage L6 is a passage through which the injection gas separated from gaseous refrigerant by the gas-liquid separator 150 is introduced into the compression chamber H3 to perform injection. The injection gas introduction passage L6 includes: a passage having one end that is open at the outer wall of the rear housing 246 and the other end that is open at an end face portion of the tubular portion 246A of the rear housing 246, the end face portion contacting the fixed scroll 222; and a passage that is connected to the former passage and that penetrates the base plate 222A of the fixed scroll 222 and is open to the compression chamber H3. Furthermore, in the bottom wall 246B of the rear housing 246, in order to allow the back pressure control valve 400 to sense injection pressure Pinj, there is formed the injection pressure sensing passage L7 that branches from the injection gas introduction passage L6 at a predetermined site and that is open to the accommodation chamber 246C.

Here, as mentioned above, back pressure Pm in the back pressure chamber H4 presses the orbiting scroll 224 against the fixed scroll 222. There is a concern that, during a compression operation of the scroll unit 220, when a resultant force of back pressures Pm acting on the back pressure chamber H4-side end face of the base plate 224A of the orbiting scroll 224 is less than a compression reaction force acting on a compression chamber H3-side end face of the base plate 224A, that is, when the back pressure is insufficient, a gap might be formed between the tip end portion of the wrap 224B of the orbiting scroll 224 and the base plate 222A of the fixed scroll 222, and a gap might be formed between the base plate 224A of the orbiting scroll 224 and the tip end portion of the warp 222B of the fixed scroll 222, resulting in decrease in volumetric efficiency of the compressor. Thus, back pressure Pm is adjusted by the back pressure control valve 400 so that the resultant force becomes greater than the compression reaction force.

In contrast, when the resultant force of back pressures Pm in back pressure chamber H4 is much greater than the compression reaction force, that is, when the back pressure is too high, a friction force between the fixed scroll 222 and the orbiting scroll 224 increases, resulting in decrease in mechanical efficiency of the compressor. As described below, when back pressure Pm exceeds target back pressure Pc, the back pressure control valve 400 reduces back pressure Pm to make back pressure Pm approach target back pressure Pc to avoid excessive back pressure.

Here, on the premise of being used in an air conditioner for a vehicle, operating characteristics required for the back pressure control valve 400, that is, pressure difference ΔP (Pm−Ps) between back pressure Pm and suction pressure Ps varying in accordance with injection pressure Pinj and revolution speed Nc of the scroll unit 220 will be discussed.

Figure 6:
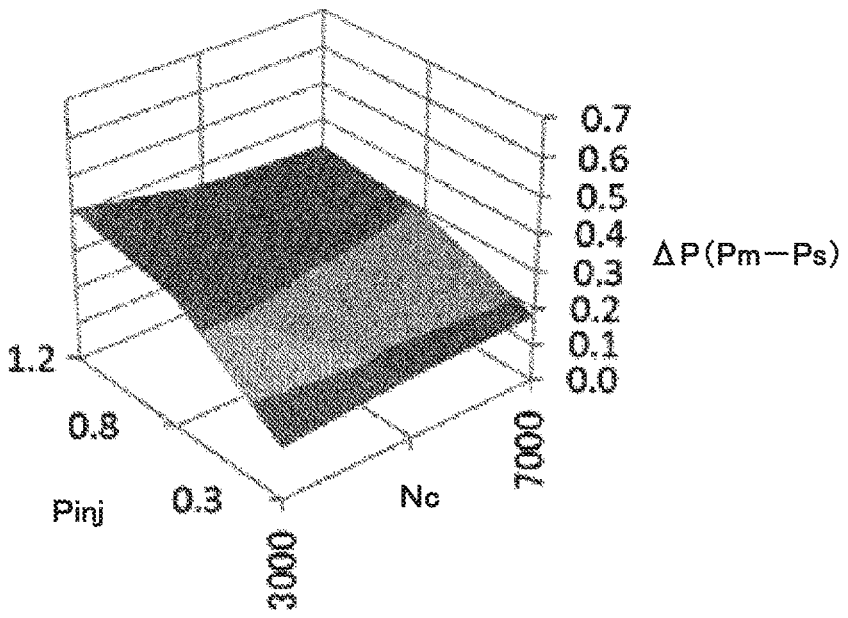
FIG. 6 is a diagram illustrating an example of operating characteristics of a back pressure control valve required during a cooling operation.
Figure 7:
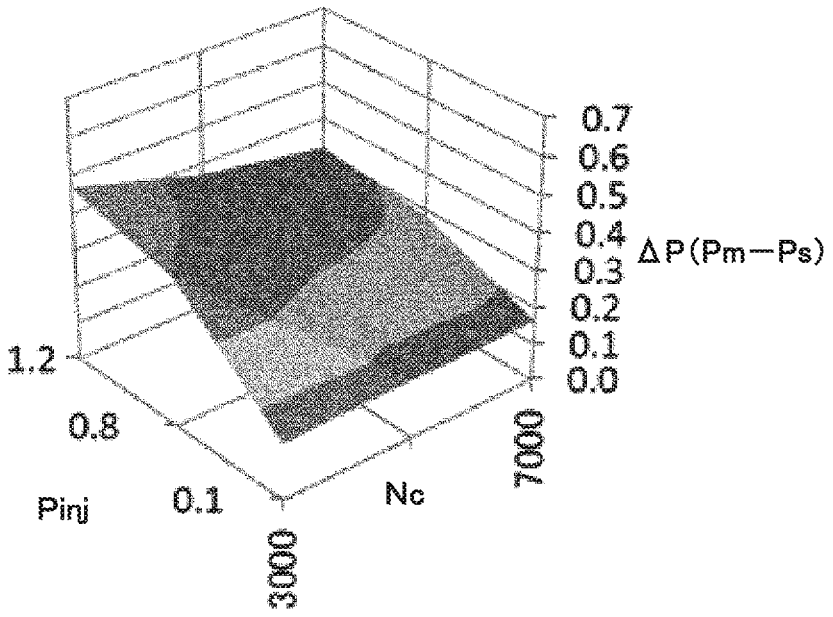
FIG. 7 is a diagram illustrating an example of operating characteristics of the back pressure control valve required during a heating operation.

FIG. 6 illustrates theoretical values of pressure difference ΔP required during a cooling operation, and FIG. 7 illustrates theoretical values of pressure difference ΔP required during a heating operation.

Referring to the theoretical values during the cooling operation and the theoretical values during the heating operation, it will be understood that varying characteristics of pressure difference ΔP in accordance with injection pressure Pinj varies in accordance with revolution speed Nc. Furthermore, it will be understood that when injection pressure Pinj is high, as revolution speed Nc increases, pressure difference ΔP decreases. In addition, it will be understood that pressure difference ΔP during the cooling operation is somewhat less than pressure difference ΔP during the heating operation. Thus, the back pressure control valve 400 increases and decreases the opening degree of the pressure supply passage L3 in accordance with at least suction pressure Ps, discharge pressure Pd, injection pressure Pinj and back pressure Pm, to perform control to obtain pressure difference ΔP indicated in FIGS. 6 and 7.

Figure 8:
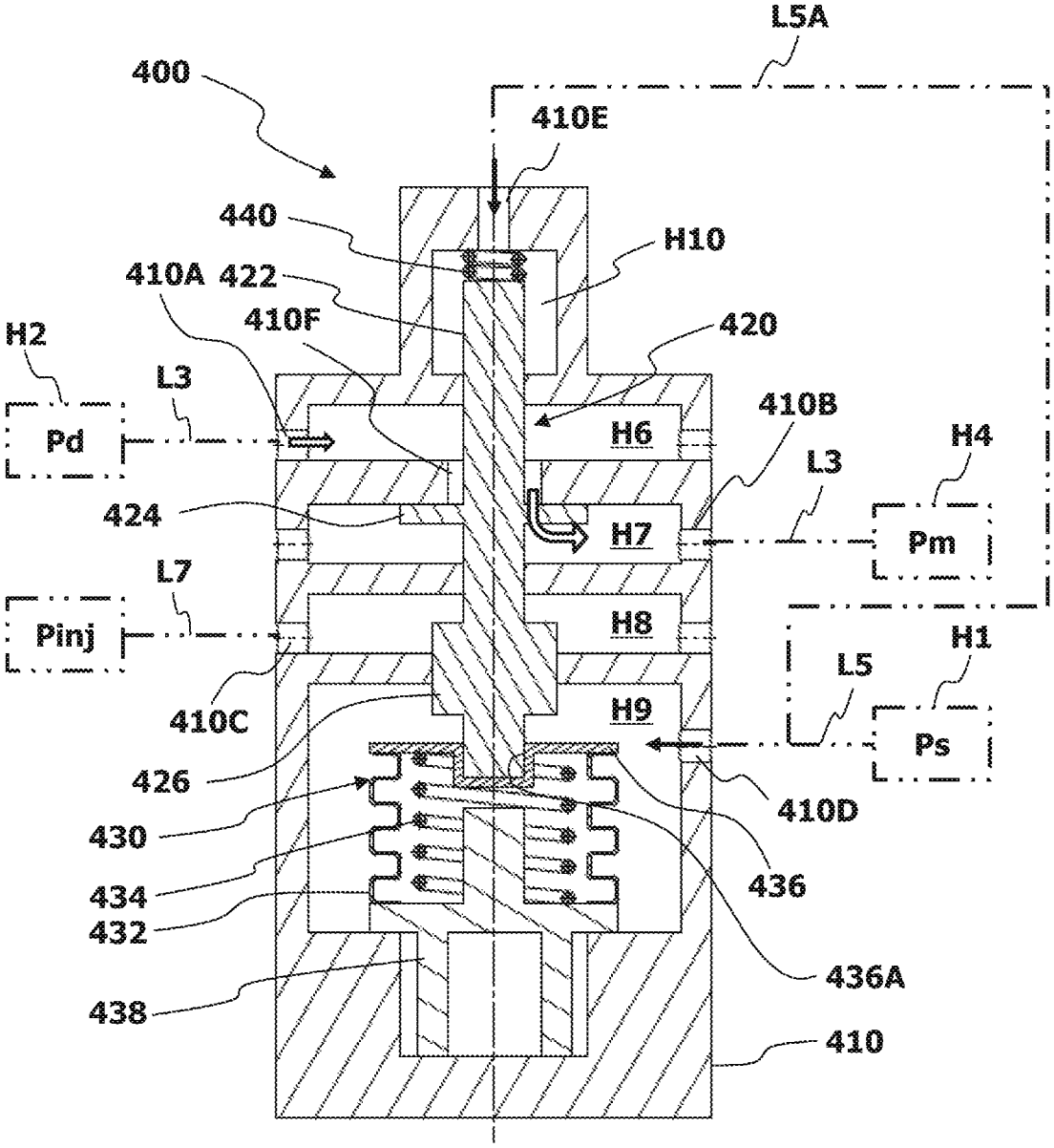
FIG. 8 is a cross-sectional view illustrating a first embodiment of the back pressure control valve.

FIG. 8 illustrates a first embodiment of the back pressure control valve 400 that adjusts the flow rate of lubricant supplied to the back pressure chamber H4.

The back pressure control valve 400 includes a valve housing 410 having a substantially cylindrical outline with a step, a valve unit 420 inserted in the valve housing 410, and a bellows assembly 430 that biases the valve unit 420 in a valve closing direction. Here, the bellows assembly 430 is given as an example of an elastic body.

In a larger diameter portion of the valve housing 410, a substantially cylindrical discharge pressure introduction chamber H6, a first pressure sensing chamber H7 and a second pressure sensing chamber H8, and a third pressure sensing chamber H9 having a substantially cylindrical shape with a step, are formed in this order along a direction departing from a smaller diameter portion of the valve housing 410. The discharge pressure introduction chamber H6 is connected to the pressure supply passage L3 on the discharge chamber H2 side via multiple first communication holes 410A formed in a peripheral wall of the larger diameter portion of the valve housing 410. The first pressure sensing chamber H7 is connected to the pressure supply passage L3 on the back pressure chamber H4 side via multiple second communication holes 410B formed in the peripheral wall of the larger diameter portion of the valve housing 410. The second pressure sensing chamber H8 is connected to the injection pressure sensing passage L7 via multiple third communication holes 410C formed in the peripheral wall of the larger diameter portion of the valve housing 410. The third pressure sensing chamber H9 is connected to the suction pressure sensing passage L5 via a fourth communication hole 410D formed in the peripheral wall of the larger diameter portion of the valve housing 410.

Furthermore, in the smaller diameter portion of the valve housing 410, a substantially cylindrical valve back pressure chamber H10 is formed. The valve back pressure chamber H10 is connected to the suction pressure sensing branch passage L5A branched from the suction pressure sensing passage L5, via a fifth communication hole 410E formed in the tip end of the smaller diameter portion of the valve housing 410.

The valve unit 420 includes a substantially cylindrical valve stem 422, a substantially disk-shaped first valve body 424, and a substantially cylindrical second valve body 426. The first valve body 424 and second valve body 426 are disposed apart from each other and is integrally formed with the valve stem 422 at the central portion in the axial direction of the valve stem 422. Here, the first valve body 424 is formed to have the outer diameter greater than that of the second valve body 426. The first valve body 424 is given as an example of a valve body.

In the central portion of the transverse section of the valve housing 410, the valve unit 420 is disposed in a manner such that the first valve body 424 of the valve unit 420 is positioned in the first pressure sensing chamber H7 and the second valve body 426 of the valve unit 420 penetrates through a partition wall between the second pressure sensing chamber H8 and the third pressure sensing chamber H9 so that the valve unit 420 is capable of reciprocating movement in the axial direction. Furthermore, in a partition wall between the discharge pressure introduction chamber H6 and the first pressure sensing chamber H7 of the valve housing 410, there is formed a sixth communication hole 410F having the inner diameter greater than the outer diameter of the valve stem 422 of the valve unit 420. Thus, when the valve unit 420 moves from the valve closing position in a valve opening direction, a distance between the partition wall and the first valve body 424 changes, and thus, it is possible to change the flow rate of a back pressure adjustment lubricant supplied from the discharge pressure introduction chamber H6 to the first pressure sensing chamber H7 while being decompressed, via the sixth communication hole 410F.

In the third pressure sensing chamber H9, there is disposed the bellows assembly 430 that biases the first valve body 424 in the valve closing direction via the valve stem 422 of the valve unit 420. The bellows assembly 430 includes a bellows 432 that is capable of expanding and contracting in the axial direction, a coil spring 434 accommodated inside the bellows 432, a first cap 436 that closes an opening provided on one end of the bellows 432 in the axial direction thereof, and a second cap 438 that closes an opening provided on the other end of the bellows 432 in the axial direction thereof and is fitted in a smaller diameter portion of the third pressure sensing chamber H9. In a cavity 436A formed at the central portion of the first cap 436, one end portion of the valve stem 422 of the valve unit 420 is fitted in a manner capable of contacting and departing.

In the valve back pressure chamber H10, there is disposed a coil spring 440 that biases the first valve body 424 of the valve unit 420 in the valve opening direction via the valve stem 422 of the valve unit 420.

Next, the adjustment operation of back pressure Pm performed by the back pressure control valve 400 will be described.

Figure 9:
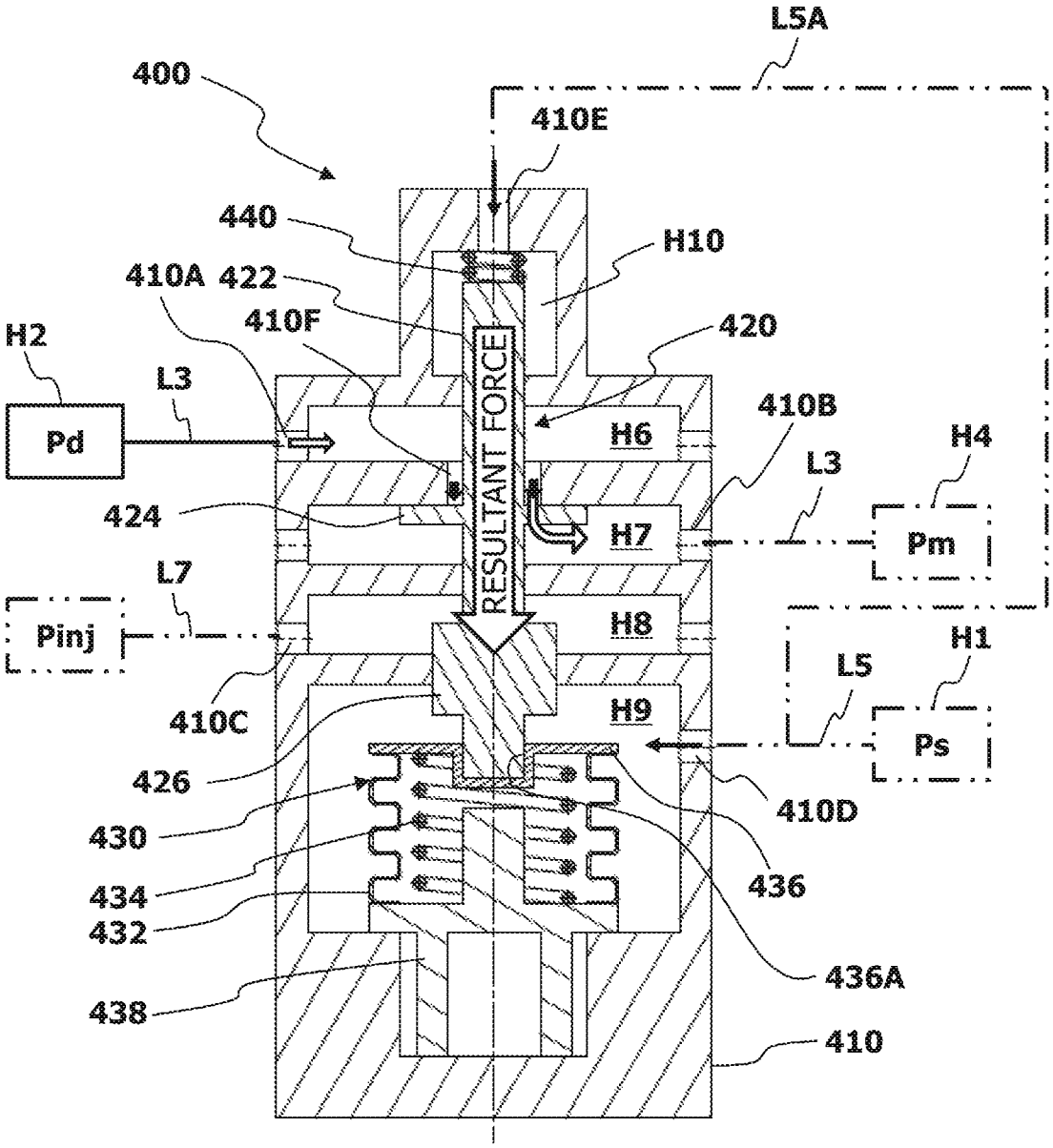
FIG. 9 is a cross-sectional view illustrating an operation of the back pressure control valve in a case in which the discharge pressure increases.

As illustrated in FIG. 9, when discharge pressure Pd increases from a state of balance, a force received by the first valve body 424 due to discharge pressure Pd via the sixth communication hole 410F increases, so that a resultant force acting on the first valve body 424, the second valve body 426, the bellows assembly 430 and the coil spring 440 is directed downward in the drawing, to move the valve unit 420 in the valve opening direction. When the valve unit 420 moves in the valve opening direction, the opening degree of the pressure supply passage L3 increases, so that the flow rate of lubricant supplied from the discharge pressure introduction chamber H6 to the first pressure sensing chamber H7 via the sixth communication hole 410F increases. Then, the flow rate of lubricant supplied to the back pressure chamber H4 via the pressure supply passage L3 increases, resulting in increase in back pressure Pm in the back pressure chamber H4.

In contrast, when discharge pressure Pd decreases from the state of balance, a force received by the first valve body 424 due to discharge pressure Pd via the sixth communication hole 410F decreases, so that the valve unit 420 moves in the valve closing direction by the biasing force of the coil spring 434 of the bellows assembly 430. Thus, the opening degree of the pressure supply passage L3 decreases, and thus, the flow rate of lubricant supplied to the back pressure chamber H4 via the pressure supply passage L3 decreases, resulting in decrease in back pressure Pm in the back pressure chamber H4.

Figure 10:
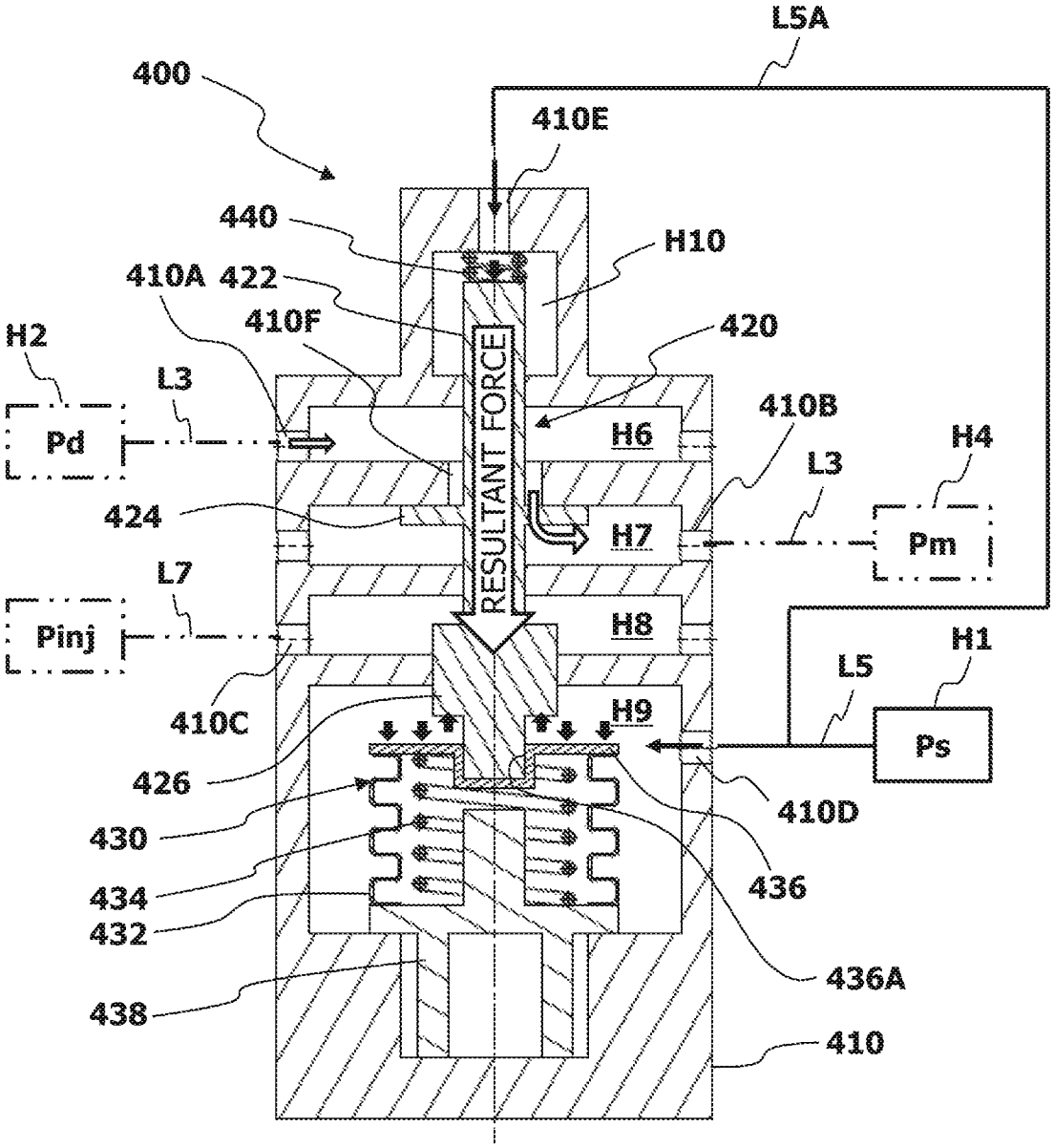
FIG. 10 is a cross-sectional view illustrating an operation of the back pressure control valve in a case in which the suction pressure increases.

As illustrated in FIG. 10, when suction pressure Ps increases from a state of balance, a force received by the first cap 436 of bellows assembly 430 and the valve stem 422 of the valve unit 420 due to suction pressure Ps increases, so that a resultant force acting on the first valve body 424, the second valve body 426, the bellows assembly 430 and the coil spring 440 is directed downward in the drawing, to move the valve unit 420 in the valve opening direction. When the valve unit 420 moves in the valve opening direction, the opening degree of the pressure supply passage L3 increases, so that the flow rate of lubricant supplied from the discharge pressure introduction chamber H6 to the first pressure sensing chamber H7 via the sixth communication hole 410F increases. Then, the flow rate of the lubricant supplied to the back pressure chamber H4 via the pressure supply passage L3 increases, resulting in increase in back pressure Pm in the back pressure chamber H4.

In contrast, when suction pressure Ps decreases from the state of balance, a force received by the first cap 436 of the bellows assembly 430 and the valve stem 422 of the valve unit 420 due to suction pressure Ps decreases, so that the valve unit 420 moves in the valve closing direction by the biasing force of the coil spring 434 of the bellows assembly 430. Thus, the opening degree of the pressure supply passage L3 decreases, and thus, the flow rate of the lubricant supplied to the back pressure chamber H4 via the pressure supply passage L3 decreases, resulting in decrease in back pressure Pm in the back pressure chamber H4.

Figure 11:
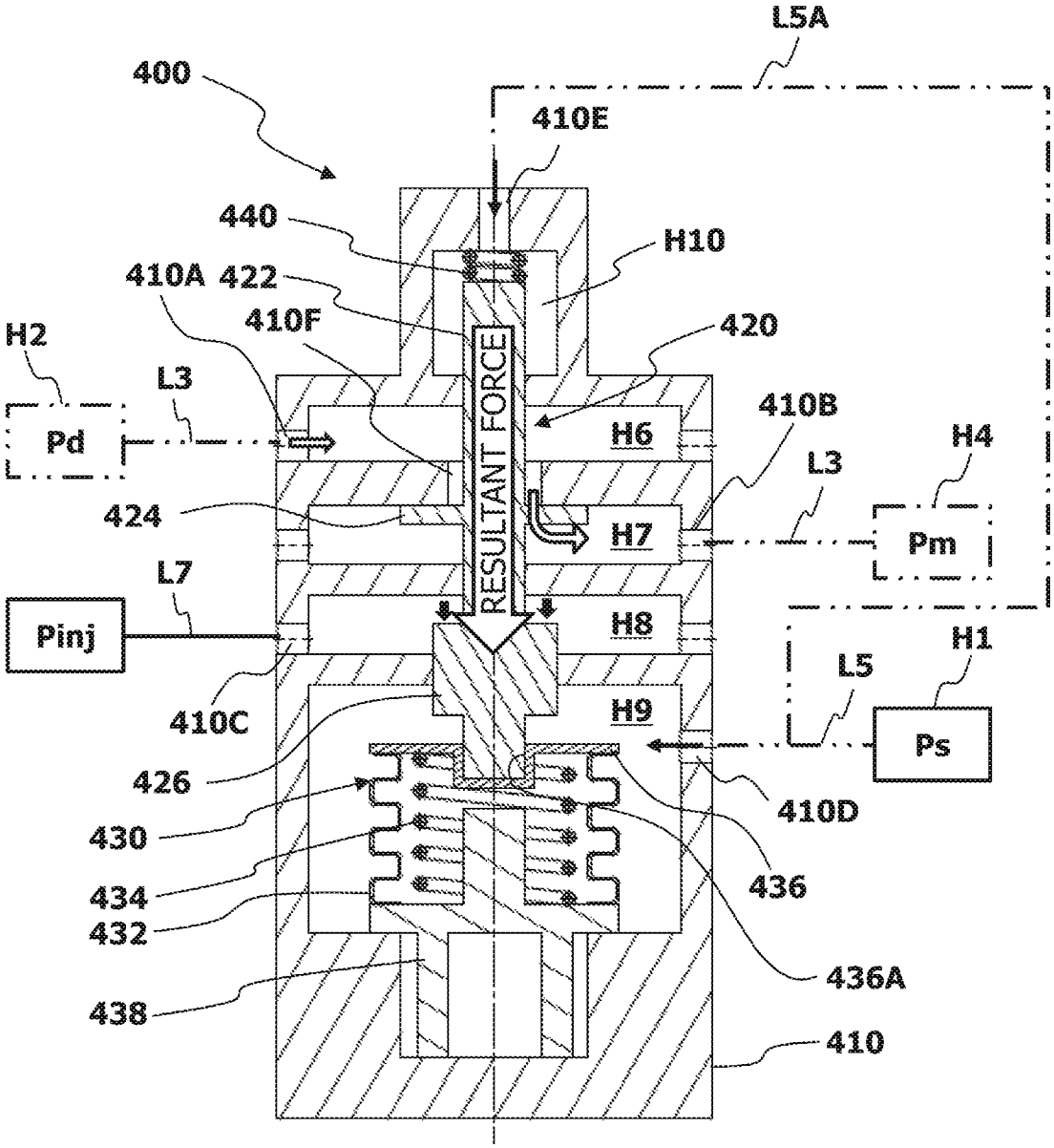
FIG. 11 is a cross-sectional view illustrating an operation of the back pressure control valve in a case in which the injection pressure increases.

As illustrated in FIG. 11, when injection pressure Pinj increases from a state of balance, a force received by the second valve body 426 due to injection pressure Pinj increases, so that a resultant force acting on the first valve body 424, the second valve body 426, the bellows assembly 430 and the coil spring 440 is directed downward in the drawing, to move the valve unit 420 in the valve opening direction. When the valve unit 420 moves in the valve opening direction, the opening degree of the pressure supply passage L3 increases, so that the flow rate of lubricant supplied from the discharge pressure introduction chamber H6 to the first pressure sensing chamber H7 via the sixth communication hole 410F increases. Then, the flow rate of lubricant supplied to the back pressure chamber H4 via the pressure supply passage L3 increases, resulting in increase in back pressure Pm in the back pressure chamber H4.

In contrast, when injection pressure Pinj decreases from the state of balance, a force received by the second valve body 426 due to injection pressure Pinj decreases, so that the valve unit 420 moves in the valve closing direction by the biasing force of the coil spring 434 of the bellows assembly 430. Thus, the opening degree of the pressure supply passage L3 decreases, and thus, the flow rate of lubricant supplied to the back pressure chamber H4 via the pressure supply passage L3 decreases, resulting in decrease in back pressure Pm in the back pressure chamber H4.

Figure 12:
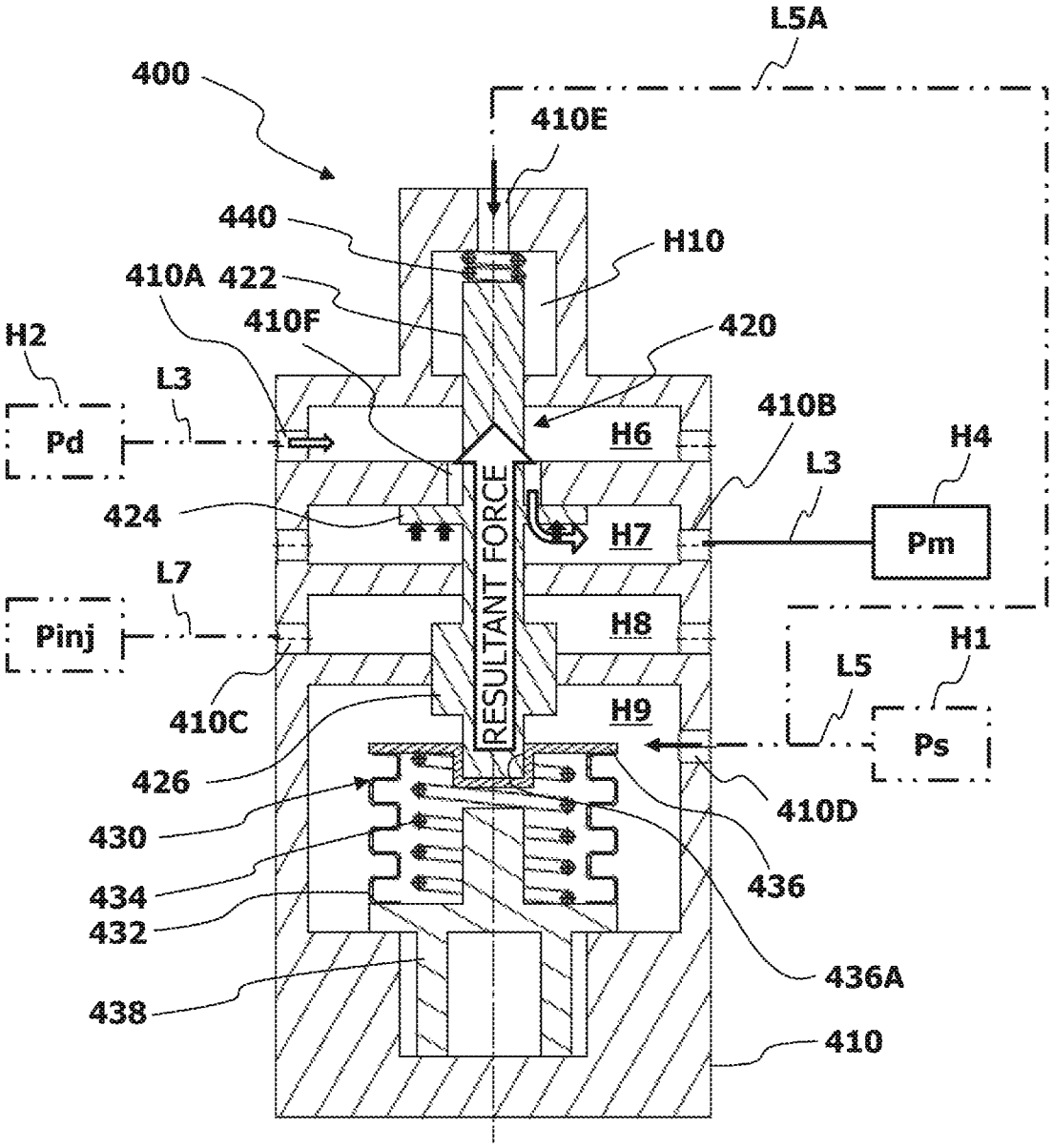
FIG. 12 is a cross-sectional view illustrating an operation of the back pressure control valve in a case in which the back pressure increases.

As illustrated in FIG. 12, when back pressure Pm increases from a state of balance, a force received by the first valve body 424 due to back pressure Pm increases, so that a resultant force acting on the first valve body 424, the second valve body 426, the bellows assembly 430 and the coil spring 440 is directed upward in the drawing, to move the valve unit 420 in the valve closing direction. When the valve unit 420 moves in the valve closing direction, the opening degree of the pressure supply passage L3 decreases, so that the flow rate of lubricant supplied from the discharge pressure introduction chamber H6 to the first pressure sensing chamber H7 via the sixth communication hole 410F decreases. Then, the flow rate of lubricant supplied to the back pressure chamber H4 via the pressure supply passage L3 decreases, resulting in decrease in back pressure Pm in the back pressure chamber H4.

In contrast, when back pressure Pm decreases from the state of balance, a force received by the first valve body 424 due to back pressure Pm decreases, so that the valve unit 420 moves in the valve opening direction by the biasing force of the coil spring 440. Thus, the opening degree of the pressure supply passage L3 increases, and thus, the flow rate of lubricant supplied to the back pressure chamber H4 via the pressure supply passage L3 increases, resulting in increase in back pressure Pm in the back pressure chamber H4.

Figure 13:
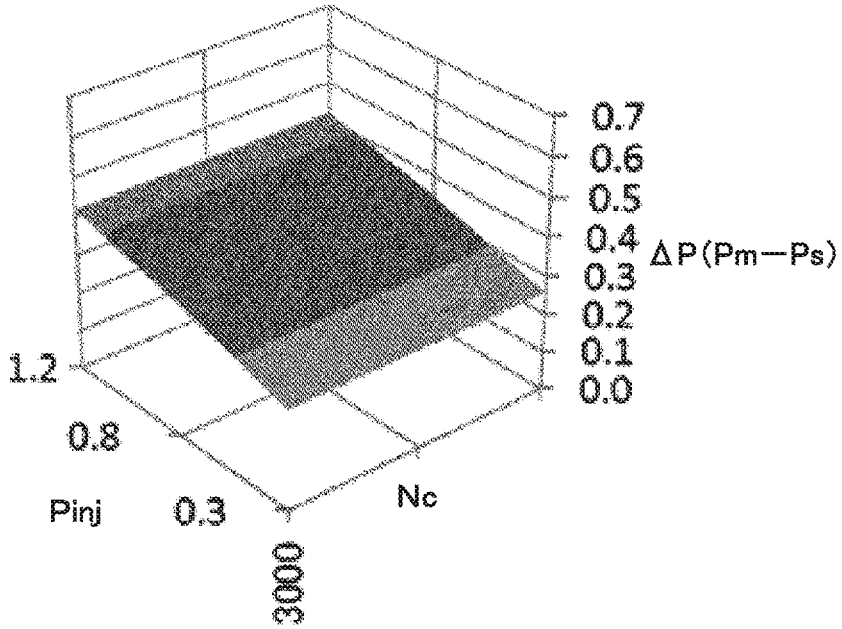
FIG. 13 is a diagram illustrating an example of operating characteristics of the back pressure control valve achieved during the cooling operation.
Figure 14:
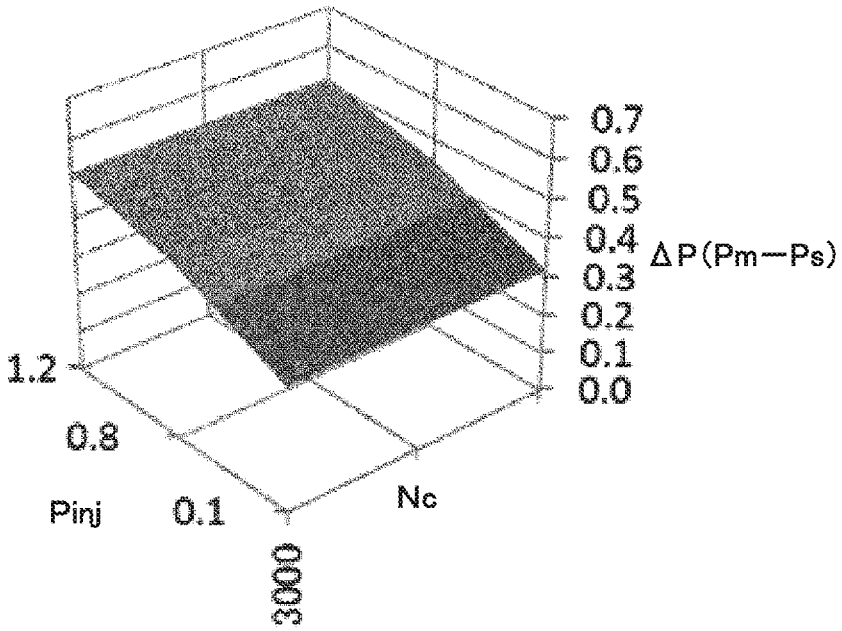
FIG. 14 is a diagram illustrating an example of operating characteristics of the back pressure control valve achieved during the heating operation.

Thus, the back pressure control valve 400 makes it possible to achieve the operating characteristics indicated in FIG. 13 (during cooling operation) and FIG. 14 (during heating operation) by appropriately setting a pressure receiving area of each part of the valve unit 420, a pressure receiving area and a spring constant of the bellows assembly 430, a spring constant of the coil spring 440, and the like. Referring to these operating characteristics, it will be understood that the back pressure control valve 400 adjusts back pressure Pm in the back pressure chamber H4 in accordance with injection pressure Pinj as well as suction pressure Ps and discharge pressure Pd. Thus, in the scroll compressor 200 to which the injection cycle is applied, it is possible to optimize the back pressure.

In short, the back pressure control valve 400 causes the first valve body 424 that is biased in the valve closing direction by the bellows assembly 430 and back pressure Pm in the back pressure chamber H4, to move in the valve opening direction by means of suction pressure Ps, discharge pressure Pd and injection pressure Pinj. Then, the back pressure control valve 400 causes the flow rate of lubricant which has been separated from gaseous refrigerant compressed in the compression chamber H3 and is supplied to the back pressure chamber H4 to increase and decrease, so as to adjust back pressure Pm in the back pressure chamber H4.

Figure 15:
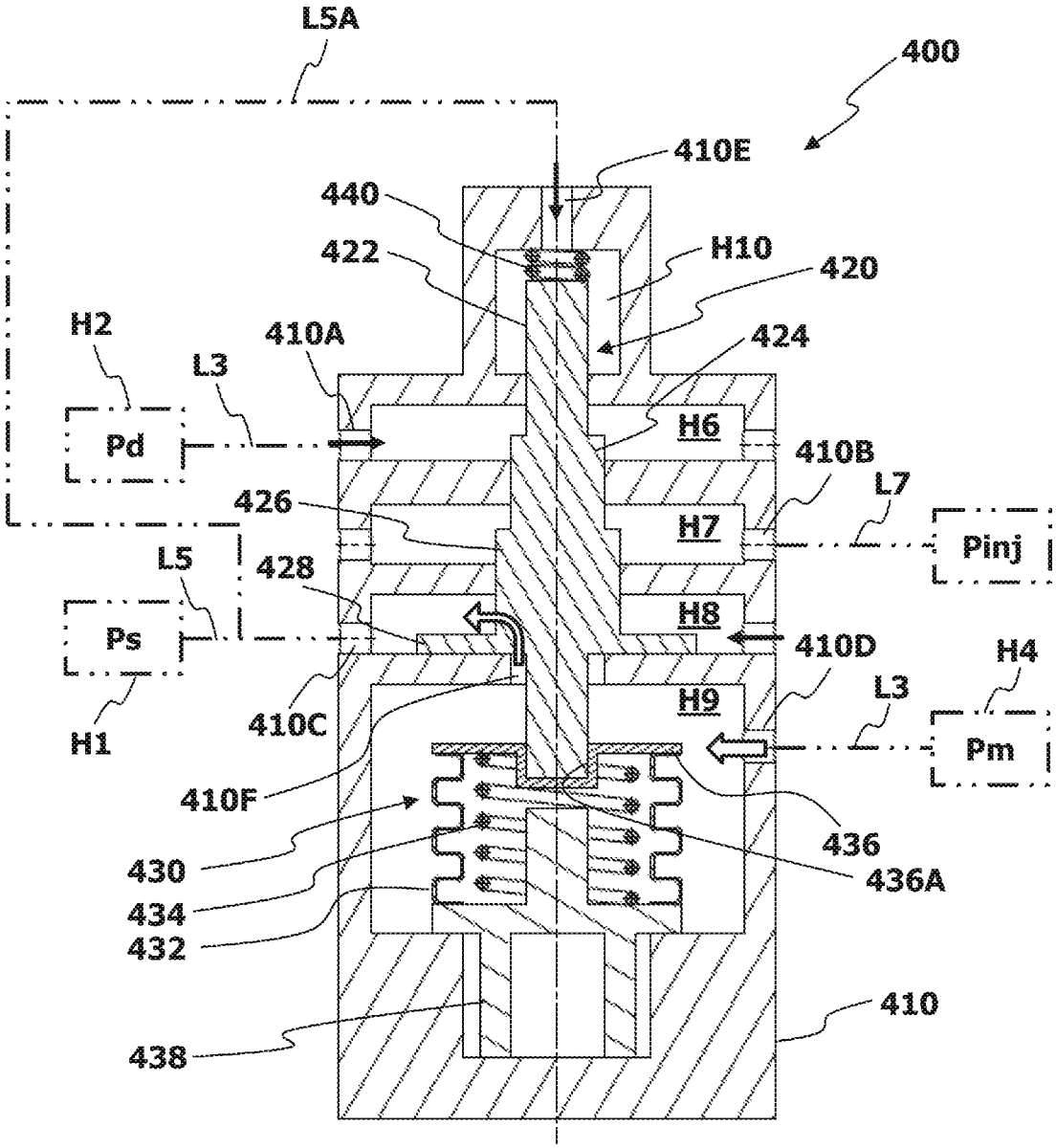
FIG. 15 is a cross-sectional view illustrating a second embodiment of the back pressure control valve.

FIG. 15 illustrates a second embodiment of the back pressure control valve 400 that adjusts the flow rate of lubricant supplied to the back pressure chamber H4 on the outlet side (downstream side) of the back pressure chamber H4. In the second embodiment, the first communication holes 410A and the fourth communication holes 410D of the back pressure control valve 400 are provided along the pressure release passage L4 for returning the back pressure adjustment lubricant from the back pressure chamber H4 to the suction chamber H1.

The back pressure control valve 400 includes a valve housing 410 having a substantially cylindrical outline with a step, a valve unit 420 inserted in the valve housing 410, and a bellows assembly 430 that biases the valve unit 420 in a valve opening direction. Here, the bellows assembly 430 is given as an example of an elastic body.

In a larger diameter portion of the valve housing 410, a substantially cylindrical discharge pressure introduction chamber H6, a first pressure sensing chamber H7 and a second pressure sensing chamber H8, and a third pressure sensing chamber H9 having a substantially cylindrical shape with a step, are formed in this order along a direction departing from a smaller diameter portion of the valve housing 410. The discharge pressure introduction chamber H6 is connected to the pressure supply passage L3 on the discharge chamber H2 side via multiple first communication holes 410A formed in a peripheral wall of the larger diameter portion of the valve housing 410. The first pressure sensing chamber H7 is connected to the injection pressure sensing passage L7 via multiple second communication holes 410B formed in the peripheral wall of the larger diameter portion of the valve housing 410. The second pressure sensing chamber H8 is connected to the suction pressure sensing passage L5 via multiple third communication holes 410C formed in the peripheral wall of the larger diameter portion of the valve housing 410. The third pressure sensing chamber H9 is connected to the pressure supply passage L3 on the back pressure chamber H4 side via a fourth communication hole 410D formed in the peripheral wall of the larger diameter portion of the valve housing 410.

Furthermore, in the smaller diameter portion of the valve housing 410, a substantially cylindrical valve back pressure chamber H10 is formed. The valve back pressure chamber H10 is connected to the suction pressure sensing branch passage L5A branched from the suction pressure sensing passage L5, via a fifth communication hole 410E formed in the tip end of the smaller diameter portion of the valve housing 410.

The valve unit 420 includes a substantially cylindrical valve stem 422, a substantially cylindrical first valve body 424, a substantially cylindrical second valve body 426, and a substantially disk-shaped third valve body 428. The first valve body 424, second valve body 426 and third valve body 428 are integrally and continuously formed with the valve stem 422 at the central portion in the axial direction of the valve stem 422. Here, the first valve body 424, second valve body 426, and third valve body 428 are formed to have increasing outer diameters, in this order. The third valve body 428 is given as an example of a valve body.

In the central portion of the transverse section of the valve housing 410, the valve unit 420 is disposed in a manner such that the first valve body 424 of the valve unit 420 penetrates through a partition wall between the discharge pressure introduction chamber H6 and the first pressure sensing chamber H7, the second valve body 426 of the valve unit 420 penetrates through a partition wall between the first pressure sensing chamber H7 and the second pressure sensing chamber H8, and the third valve body 428 of the valve unit 420 is positioned in the second pressure sensing chamber H8 so that the valve unit 420 is capable of reciprocating movement in the axial direction. Furthermore, in a partition wall between the second pressure sensing chamber H8 and the third pressure sensing chamber H9 of the valve housing 410, there is formed a sixth communication hole 410F having the inner diameter greater than the outer diameter of the valve stem 422 of the valve unit 420. Thus, when the valve unit 420 moves from the valve closing position in a valve opening direction, a distance between the partition wall and the third valve body 428 changes, and thus, it is possible to change the flow rate of a back pressure adjustment lubricant returning from the third pressure sensing chamber H9 to the second pressure sensing chamber H8 while being decompressed, via the sixth communication hole 410F.

In the third pressure sensing chamber H9, there is disposed the bellows assembly 430 that biases the third valve body 428 in the valve opening direction via the valve stem 422 of the valve unit 420. The bellows assembly 430 includes a bellows 432 that is capable of expanding and contracting in the axial direction, a coil spring 434 accommodated inside the bellows 432, a first cap 436 that closes an opening provided on one end of the bellows 432 in the axial direction thereof, and a second cap 438 that closes an opening provided on the other end of the bellows 432 in the axial direction thereof and is fitted in a smaller diameter portion of the third pressure sensing chamber H9. In a cavity 436A formed at the central portion of the first cap 436, one end portion of the valve stem 422 of the valve unit 420 is fitted in a manner capable of contacting and departing.

In the valve back pressure chamber H10, there is disposed a coil spring 440 that biases the third valve body 428 of the valve unit 420 in the valve closing direction via the valve stem 422 of the valve unit 420.

Next, the adjustment operation of back pressure Pm performed by the back pressure control valve 400 will be described.

Figure 16:
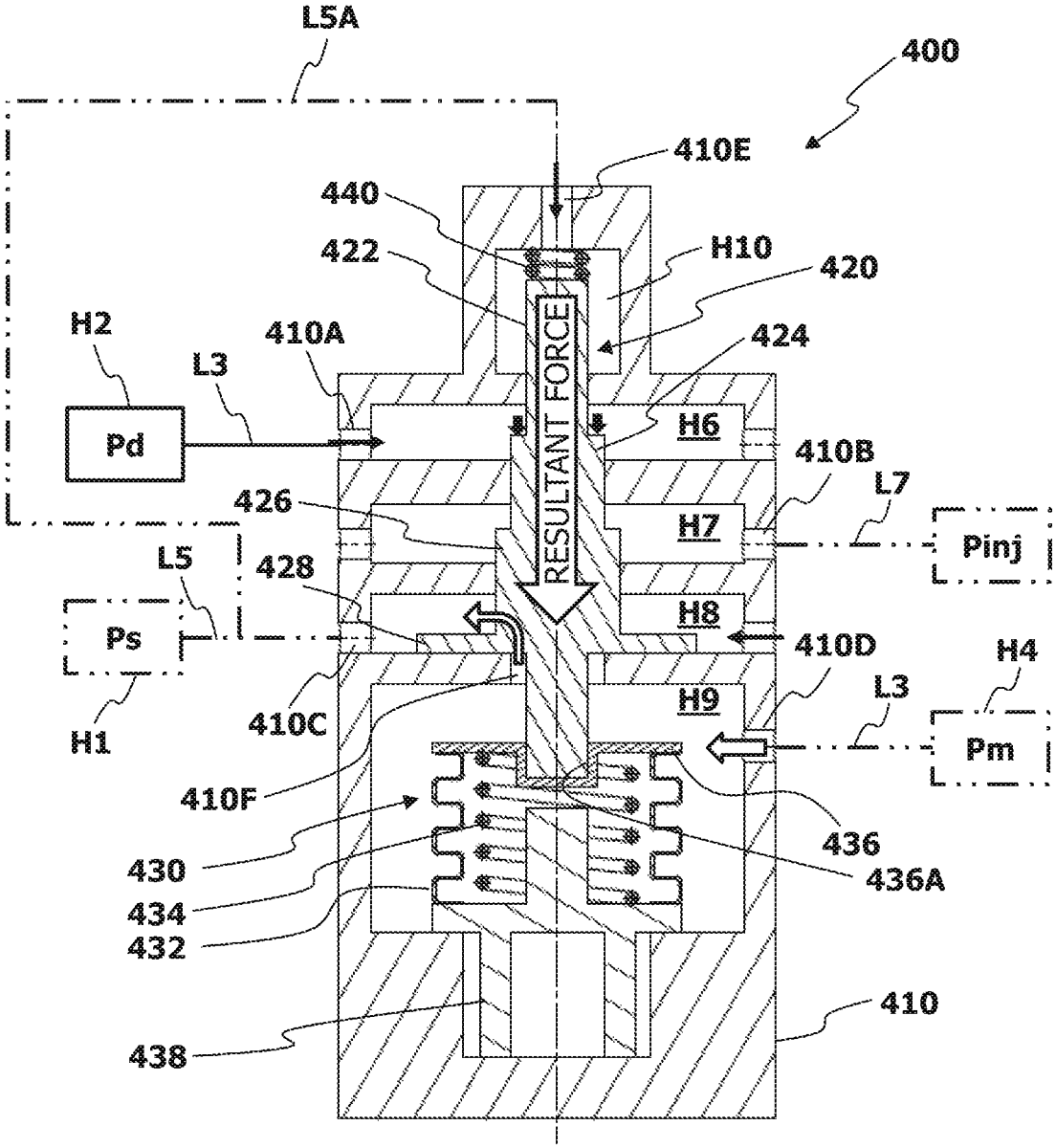
FIG. 16 is a cross-sectional view illustrating an operation of the back pressure control valve in a case in which the discharge pressure increases.

As illustrated in FIG. 16, when discharge pressure Pd increases from a state of balance, a force received by the first valve body 424 due to discharge pressure Pd increases, so that a resultant force acting on the first valve body 424, the second valve body 426, the third valve body 428, the bellows assembly 430 and the coil spring 440 is directed downward in the drawing, to move the valve unit 420 in the valve closing direction. When the valve unit 420 moves in the valve closing direction, the opening degree of the pressure release passage L4 decreases, so that the flow rate of lubricant returning from the back pressure chamber H4 to the suction chamber H1 via the pressure release passage L4 decreases, resulting in increase in back pressure Pm in the back pressure chamber H4.

In contrast, when discharge pressure Pd decreases from the state of balance, a force received by the first valve body 424 due to discharge pressure Pd decreases, so that the valve unit 420 moves in the valve opening direction by the biasing force of the coil spring 434 of the bellows assembly 430. Thus, the opening degree of the pressure release passage L4 increases, and thus, the flow rate of lubricant returning from the back pressure chamber H4 to the suction chamber H1 via the pressure release passage L4 increases, resulting in decrease in back pressure Pm in the back pressure chamber H4.

Figure 17:
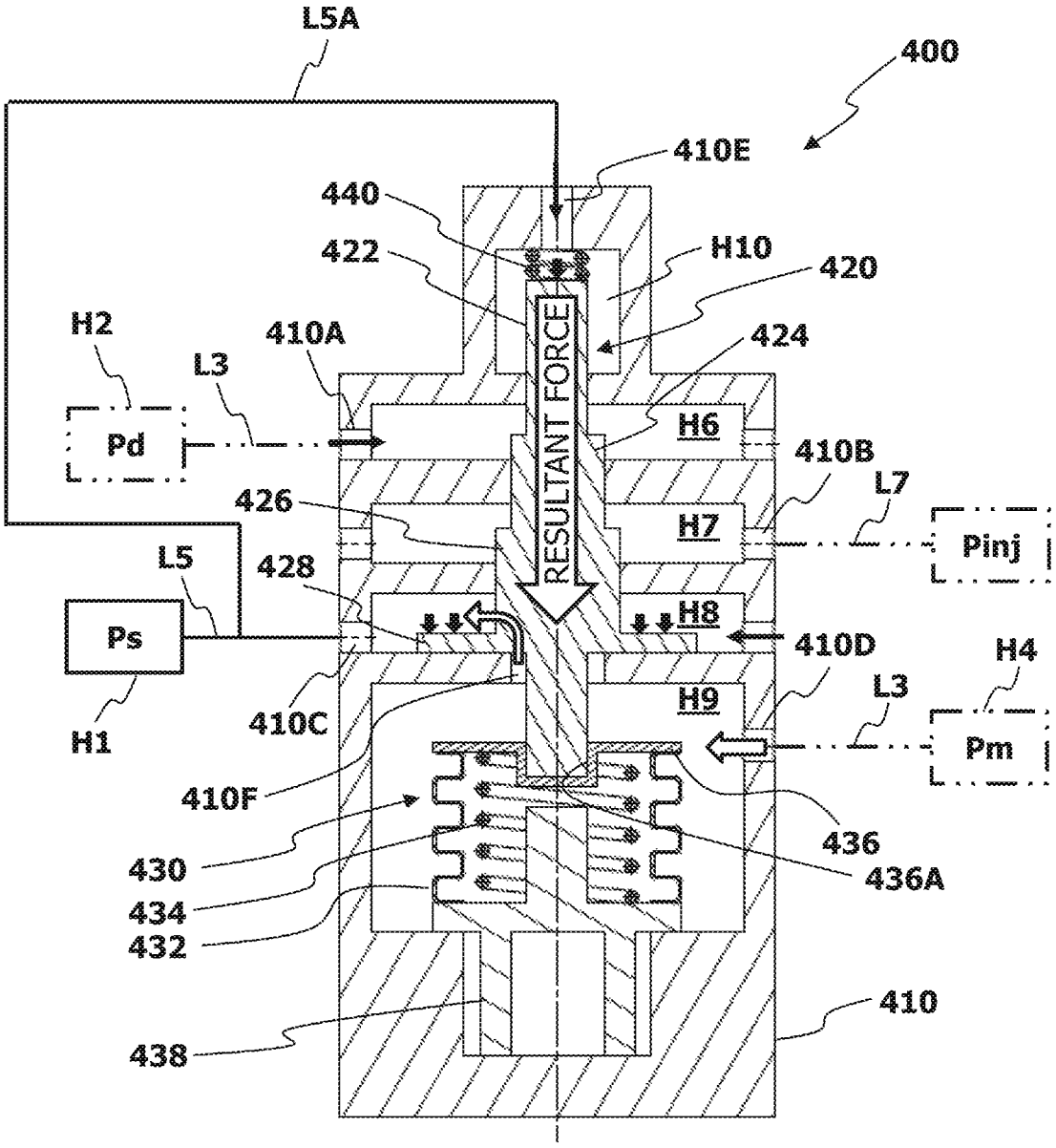
FIG. 17 is a cross-sectional view illustrating an operation of the back pressure control valve in a case in which the suction pressure increases.

As illustrated in FIG. 17, when suction pressure Ps increases from a state of balance, a force received by the third valve body 428 and the valve stem 422 of the valve unit 420 due to suction pressure Ps increases, so that a resultant force acting on the first valve body 424, the second valve body 426, the third valve body 428, the bellows assembly 430 and the coil spring 440 is directed downward in the drawing, to move the valve unit 420 in the valve closing direction. When the valve unit 420 moves in the valve closing direction, the opening degree of the pressure release passage L4 decreases, so that the flow rate of lubricant returning from the back pressure chamber H4 to the suction chamber H1 via the pressure release passage L4 decreases, resulting in increase in back pressure Pm in the back pressure chamber H4.

In contrast, when suction pressure Ps decreases from the state of balance, a force received by the third valve body 428 and the valve stem 422 of the valve unit 420 due to suction pressure Ps decreases, so that the valve unit 420 moves in the valve opening direction by the biasing force of the coil spring 434 of the bellows assembly 430. Thus, the opening degree of the pressure release passage L4 increases, and thus, the flow rate of lubricant returning from the back pressure chamber H4 to the suction chamber H1 via the pressure release passage L4 increases, resulting in decrease in back pressure Pm in the back pressure chamber H4.

Figure 18:
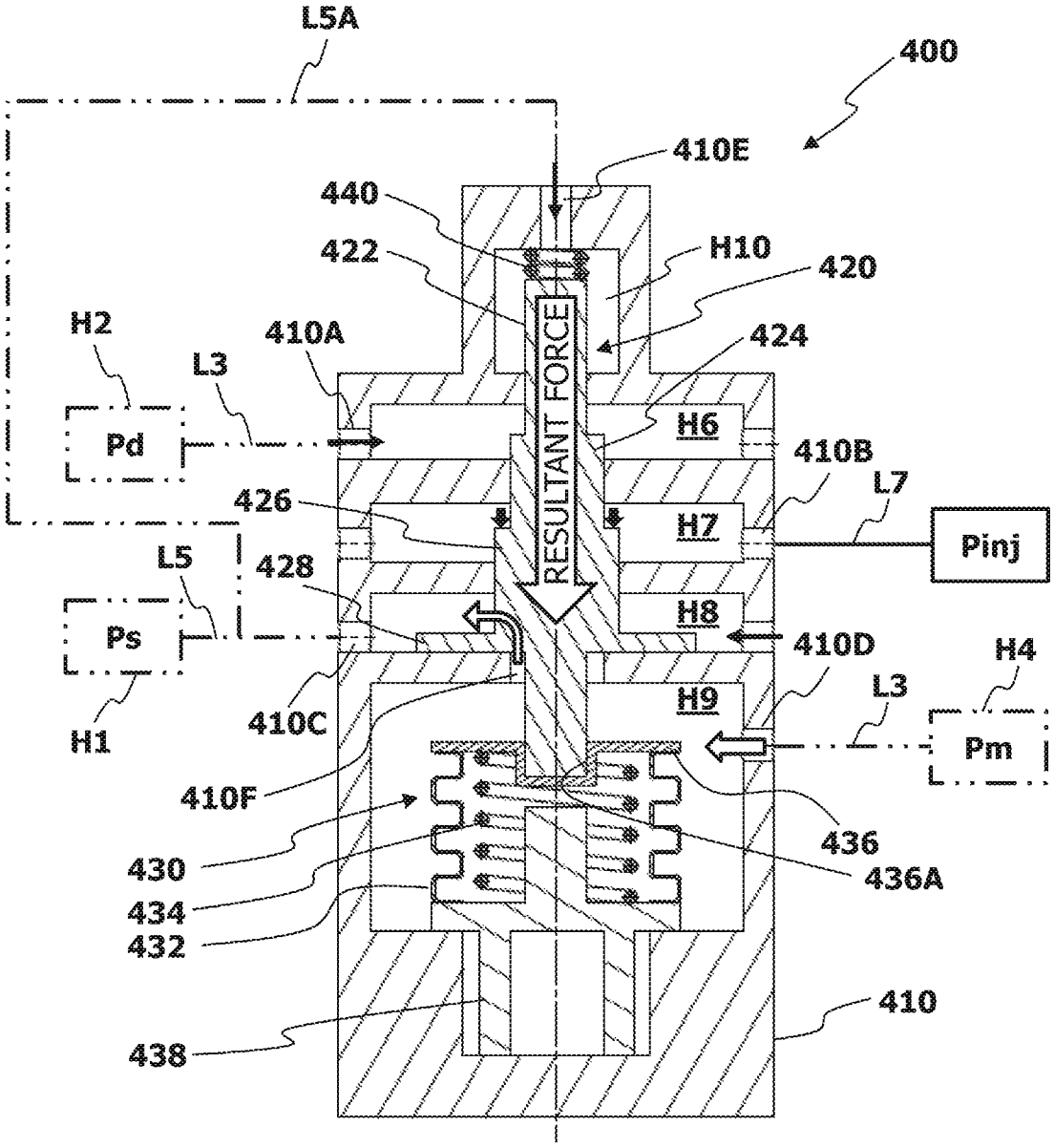
FIG. 18 is a cross-sectional view illustrating an operation of the back pressure control valve in a case in which the injection pressure increases.

As illustrated in FIG. 18, when injection pressure Pinj increases from a state of balance, a force received by the second valve body 426 due to injection pressure Pinj increases, so that a resultant force acting on the first valve body 424, the second valve body 426, the third valve body 428, the bellows assembly 430 and the coil spring 440 is directed downward in the drawing, to move the valve unit 420 in the valve closing direction. When the valve unit 420 moves in the valve closing direction, the opening degree of the pressure release passage L4 decreases, so that the flow rate of lubricant returning from the back pressure chamber H4 to the suction chamber H1 via the pressure release passage L4 decreases, resulting in increase in back pressure Pm in the back pressure chamber H4.

In contrast, when injection pressure Pinj decreases from the state of balance, a force received by the second valve body 426 due to injection pressure Pinj decreases, so that the valve unit 420 moves in the valve opening direction by the biasing force of the coil spring 434 of the bellows assembly 430. Thus, the opening degree of the pressure release passage L4 increases, and thus, the flow rate of lubricant returning from the back pressure chamber H4 to the suction chamber H1 via the pressure release passage L4 increases, resulting in decrease in back pressure Pm in the back pressure chamber H4.

Figure 19:
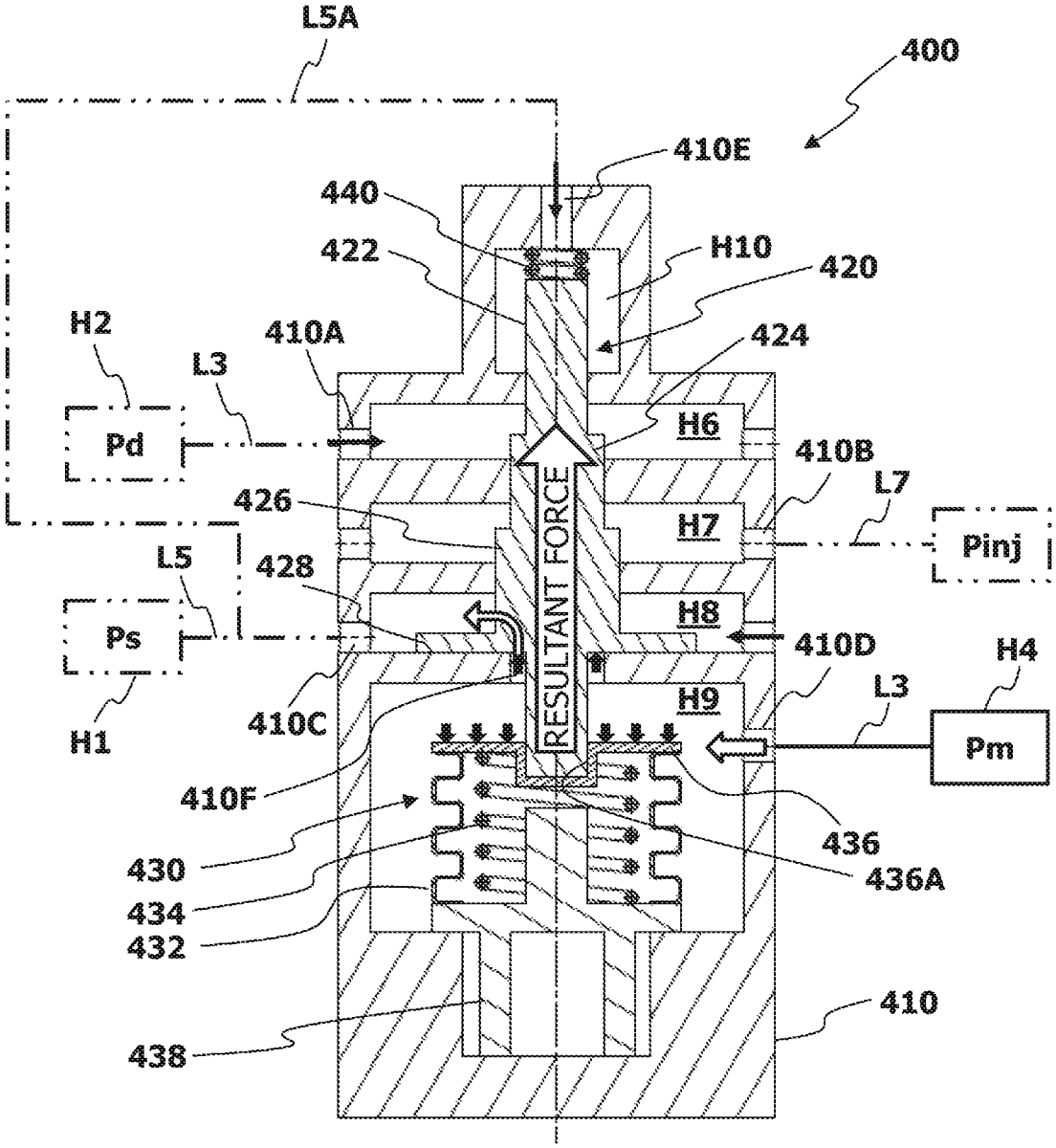
FIG. 19 is a cross-sectional view illustrating an operation of the back pressure control valve in a case in which the back pressure increases.

As illustrated in FIG. 19, when back pressure Pm increases from a state of balance, a force received by the third valve body 428 due to back pressure Pm via the sixth communication hole 410F and a force received by the bellows assembly 430 due to back pressure Pm increase, so that a resultant force acting on the first valve body 424, the second valve body 426, the third valve body 428, the bellows assembly 430 and the coil spring 440 is directed upward in the drawing, to move the valve unit 420 in the valve opening direction. When the valve unit 420 moves in the valve opening direction, the opening degree of the pressure release passage L4 increases, so that the flow rate of lubricant returning from the back pressure chamber H4 to the suction chamber H1 via the pressure release passage L4 increases, resulting in decrease in back pressure Pm in the back pressure chamber H4.

In contrast, when back pressure Pm decreases from the state of balance, a force received by the third valve body 428 due to back pressure Pm via the sixth communication hole 410F and a force received by the bellows assembly 430 due to back pressure Pm decrease, so that the valve unit 420 moves in the valve closing direction by the biasing force of the coil spring 440. Thus, the opening degree of the pressure release passage L4 decreases, and thus, the flow rate of lubricant returning from the back pressure chamber H4 to the suction chamber H1 via the pressure release passage L4 decreases, resulting in increase in back pressure Pm in the back pressure chamber H4.

Thus, similarly to the first embodiment mentioned above, the back pressure control valve 400 makes it possible to achieve the operating characteristics indicated in FIG. 13 (during cooling operation) and FIG. 14 (during heating operation) by appropriately setting a pressure receiving area of each part of the valve unit 420, a pressure receiving area and a spring constant of the bellows assembly 430, a spring constant of the coil spring 440, and the like. Thus, in the scroll compressor 200 to which the injection cycle is applied, it is possible to optimize the back pressure.

In short, the back pressure control valve 400 causes the third valve body 428 that is biased in the valve opening direction by the bellows assembly 430 and back pressure Pm in the back pressure chamber H4, to move in the valve closing direction by means of suction pressure Ps, discharge pressure Pd and injection pressure Pinj. Then, the back pressure control valve 400 causes the flow rate of lubricant which has been separated from gaseous refrigerant compressed in the compression chamber H3 and is supplied to the back pressure chamber H4, to increase and decrease, so as to adjust back pressure Pm in the back pressure chamber H4.

Figure 20:
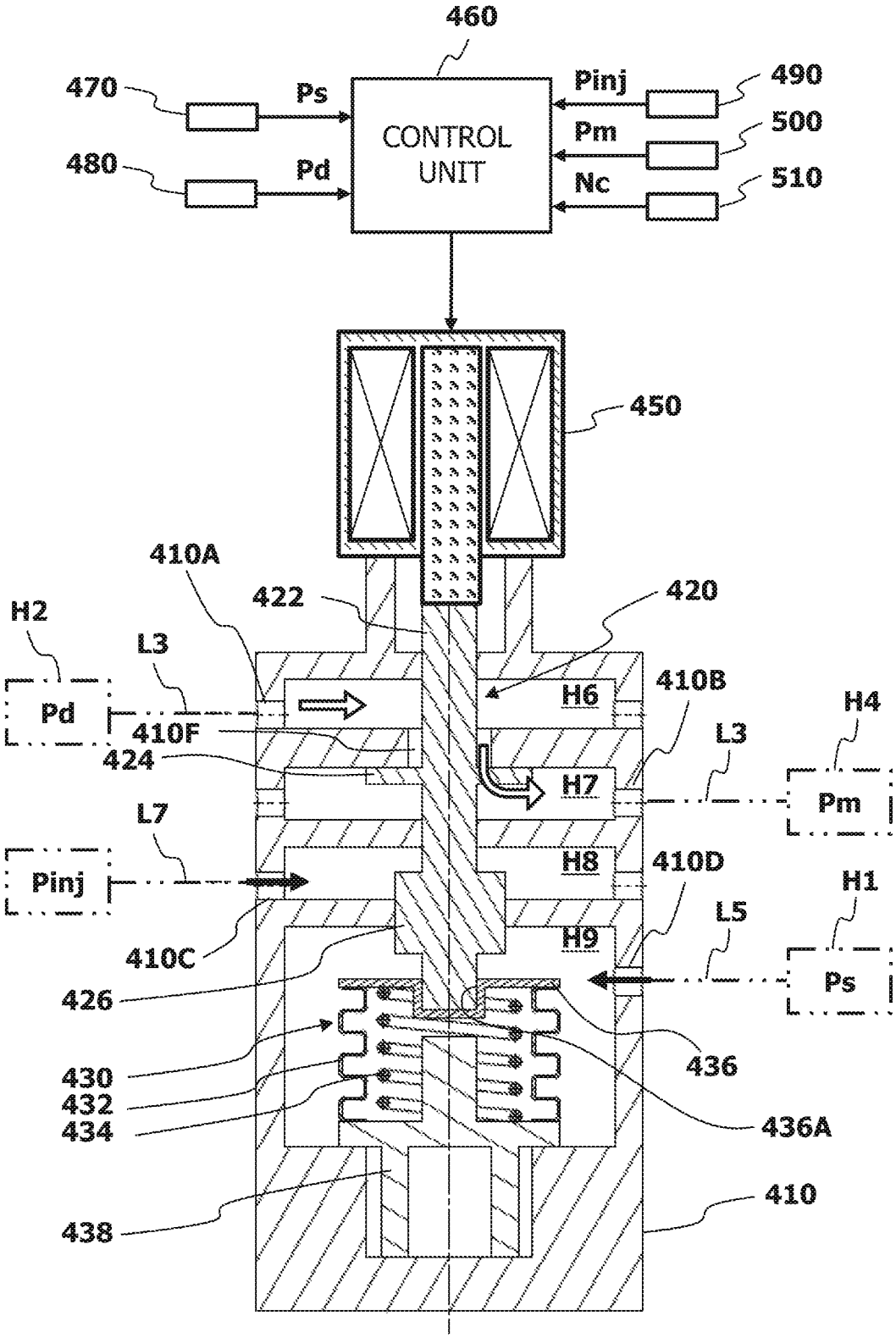
FIG. 20 is a cross-sectional view illustrating a modification of the back pressure control valve.

FIG. 20 illustrates a modification of the back pressure control valve 400 according to the first embodiment illustrated in FIG. 8.

The back pressure control valve 400 according to the modification includes an electromagnetic actuator 450 disposed in the smaller diameter portion of the valve housing 410. The back pressure control valve 400 is configured such that the electromagnetic actuator 450 forcibly moves the valve unit 420. Furthermore, to the back pressure control valve 400, a control unit 460 having an on-board microcomputer, and the like, is attached to electronically control the electromagnetic actuator 450. The control unit 460 receives output signals output from a suction pressure sensor 470 that senses suction pressure Ps, a discharge pressure sensor 480 that senses discharge pressure Pd, an injection pressure sensor 490 that senses injection pressure Pinj, a back pressure sensor 500 that senses back pressure Pm, and revolution speed sensor 510 that senses revolution speed Nc of the scroll unit 220. Since the most components of the back pressure control valve 400 according to the modification are the same as those in the first embodiment, such components are assigned the same reference symbols, and a description thereof will be omitted (the same applies hereinafter).

Figure 21:
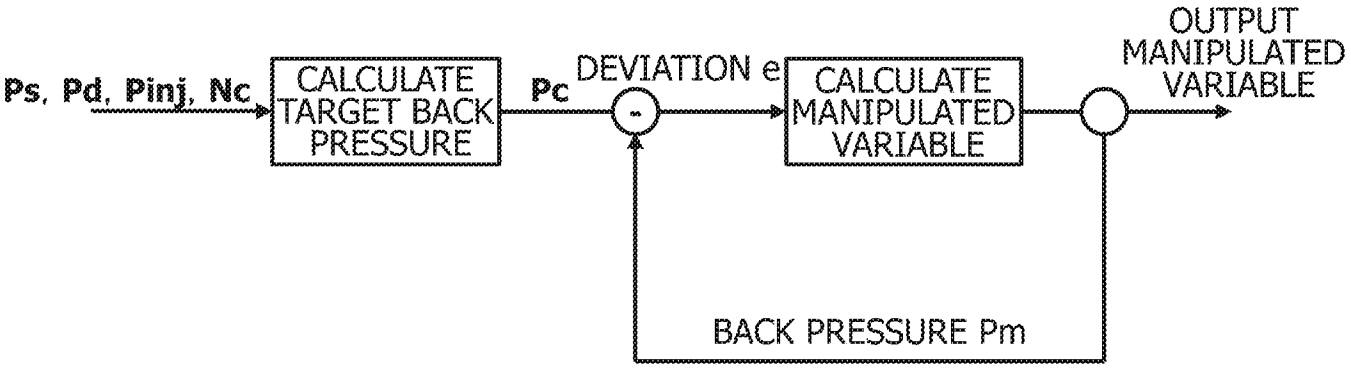
FIG. 21 is a control block diagram of an electromagnetic actuator.

As illustrated in FIG. 21, the control unit 460 calculates target back pressure Pc in accordance with suction pressure Ps, discharge pressure Pd, injection pressure Pinj and revolution speed Nc, and outputs a manipulated variable in accordance with deviation e between back pressure Pm and target back pressure Pc, to the electromagnetic actuator 450. Thus, even if back pressure Pm were to deviate from target back pressure Pc in an autonomous control, since the electromagnetic actuator 450 can forcibly correct this deviation, the back pressure control valve 400 according to the modification makes it possible to improve control accuracy of back pressure Pm. Here, as the manipulated variable, a current value, a voltage value, a duty ratio, or the like, may be used, for example.

Figure 22:
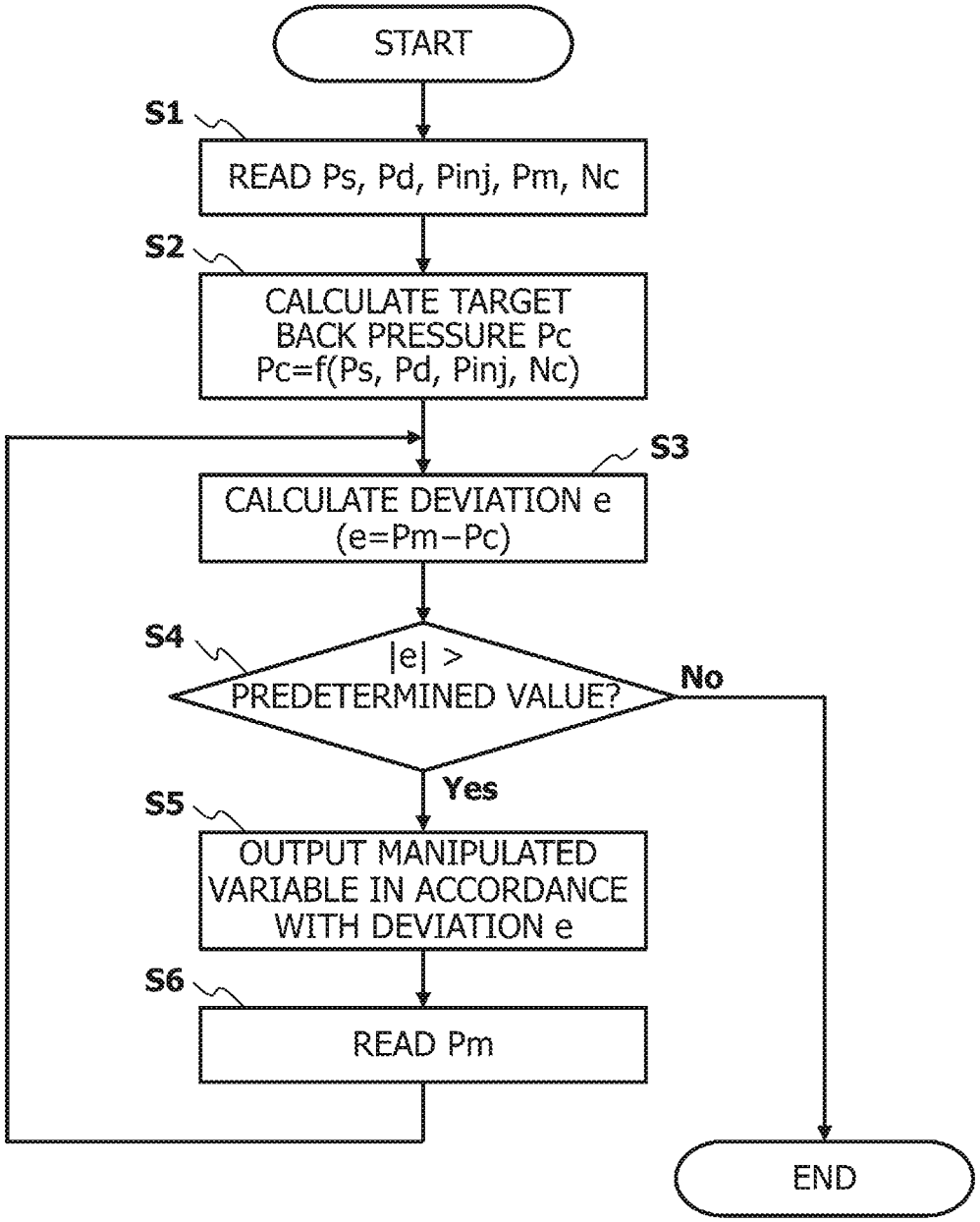
FIG. 22 is a flowchart illustrating an example of a control of the electromagnetic actuator.

FIG. 22 illustrates an example of a control of the electromagnetic actuator 450, repeatedly carried out every predetermined time by the control unit 460.

In Step 1 (abbreviated as "S1" in the drawing; the same applies hereinafter), the control unit 460 reads suction pressure Ps, discharge pressure Pd, injection pressure Pinj, back pressure Pm and revolution speed Nc from the suction pressure sensor 470, the discharge pressure sensor 480, the injection pressure sensor 490, the back pressure sensor 500 and the revolution speed sensor 510, respectively.

In Step 2, to achieve the operating characteristics indicated in FIGS. 6 and 7, the control unit 460 refers to a control map in which target back pressure is set as a target control value in accordance with suction pressure, discharge pressure, injection pressure and revolution speed, and calculates target back pressure Pc in accordance with suction pressure Ps, discharge pressure Pd, injection pressure Pinj and revolution speed Nc. Here, the control map may be obtained experimentally and theoretically, for example.

In Step 3, the control unit 460 calculates deviation e (e=Pm−Pc) obtained by subtracting target back pressure Pc from back pressure Pm.

In Step 4, the control unit 460 determines whether an absolute value of deviation e is greater than a predetermined value. Here, the predetermined value is a threshold for determining whether back pressure Pm approaches target back pressure Pc, that is, whether back pressure Pm becomes equal to target back pressure Pc by a feed-back control, and for example, the predetermined value may be appropriately set in accordance with the operating characteristics of the back pressure control valve 400, required accuracy of back pressure, or the like. Then, when the control unit 460 determines that the absolute value of deviation e is greater than the predetermined value (Yes), the process proceeds to Step 5. On the other hand, when the control unit 460 determines that the absolute value of deviation e is less than or equal to the predetermined value (No), the process ends.

In Step 5, the control unit 460 outputs a manipulated variable in accordance with deviation e to the electromagnetic actuator 450.

In Step 6, the control unit 460 reads back pressure Pm from the back pressure sensor 500, and thereafter, the process is returned to Step 3.

Figure 23:
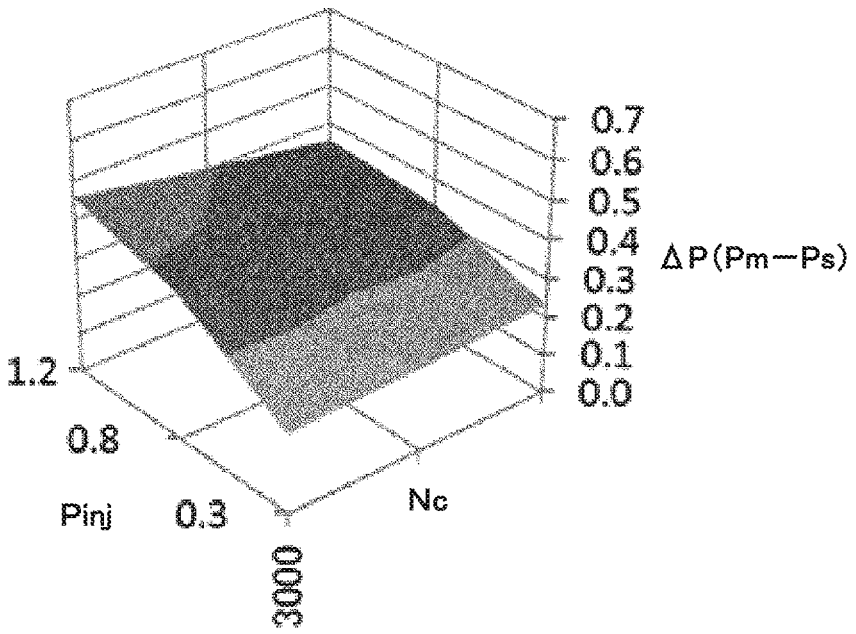
FIG. 23 is a diagram illustrating an example of operating characteristics of the back pressure control valve achieved during the cooling operation.
Figure 24:
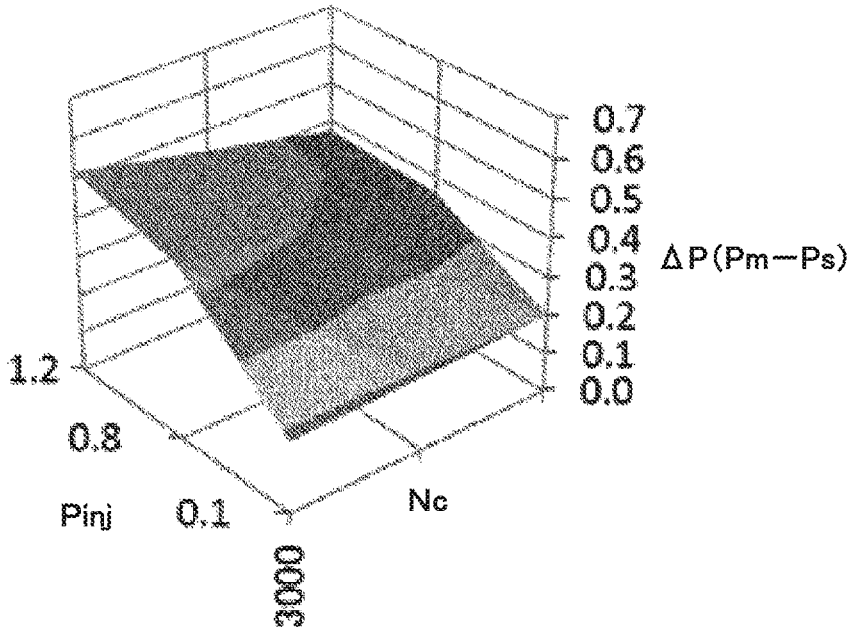
FIG. 24 is a diagram illustrating an example of operating characteristics of the back pressure control valve achieved during the heating operation.

In this way, even if back pressure Pm were to deviate from target back pressure Pc in the autonomous control, the electromagnetic actuator 450 is feedback controlled such that back pressure Pm approaches target back pressure Pc. Thus, the back pressure control valve 400 makes it possible to achieve the operating characteristics indicated in FIG. 23 (during cooling operation) and FIG. 24 (during heating operation). Referring to these operating characteristics, it will be understood that the back pressure control valve 400 adjusts back pressure Pm in the back pressure chamber H4 in accordance with revolution speed Nc as well as suction pressure Ps, discharge pressure Pd and injection pressure Pinj. Thus, it is possible to improve the control accuracy of the flow rate of lubricant supplied to the back pressure chamber H4 of the scroll compressor 200, and to reduce deviation between back pressure Pm and target back pressure Pc.

Figure 25:
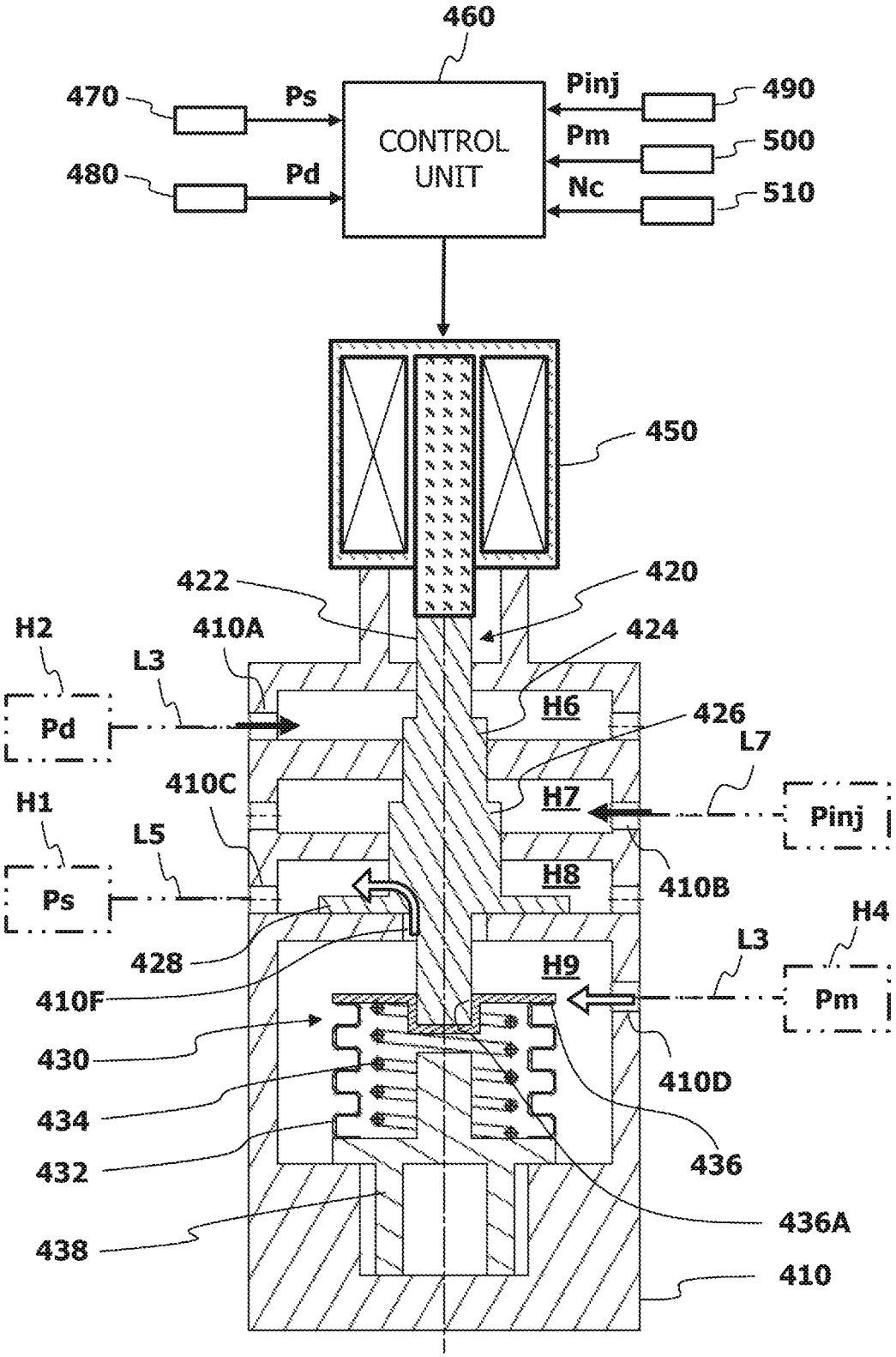
FIG. 25 is a cross-sectional view illustrating another modification of the back pressure control valve.

As the back pressure control valve 400 provided with the electromagnetic actuator 450, the back pressure control valve 400 according to the second embodiment (see FIG. 15), which controls the flow rate on the outlet side of the back pressure chamber H4, may be adopted as a premise, as illustrated in FIG. 25. Since operations and effects of this back pressure control valve 400 are similar to those of the back pressure control valve 400 according to the modification, their description is omitted.

Here, if the required control accuracy of back pressure Pm is not high, target back pressure Pc may be calculated in accordance with suction pressure Ps, discharge pressure Pd and injection pressure Pinj, without using revolution speed Nc. In this way, it is possible to achieve characteristics with a control accuracy superior to that of the autonomous back pressure control valve 400 while reducing an increase in control load.

As the back pressure control valve 400, a known flow rate control valve that directly drives a valve body by an electromagnetic actuator may be employed, for example. In this case, the back pressure control valve 400 is electronically controlled according to the control indicated in FIG. 22.

REFERENCE SYMBOL LIST

100 Refrigeration cycle (refrigerant circuit)
200 Scroll compressor
220 Scroll unit
222 Fixed scroll
224 Orbiting scroll
400 Back pressure control valve
424 First valve body (valve body)
428 Third valve body (valve body)
430 Bellows assembly (elastic body)
450 Electromagnetic actuator
460 Control unit
470 Suction pressure sensor

480 Discharge pressure sensor
490 Injection pressure sensor
500 Back pressure sensor
510 Revolution speed sensor
H3 Compression chamber
H4 Back pressure chamber
L3 Pressure supply passage
L4 Pressure release passage

The invention claimed is:

1. A scroll compressor comprising:

a scroll unit that increases and decreases a capacity of a compression chamber defined by a fixed scroll and an orbiting scroll, and injects a gaseous refrigerant which has been taken out from the middle of a refrigerant circuit, into the compression chamber, to draw in, compress and discharge the gaseous refrigerant; and a back pressure control valve that adjusts a pressure in a back pressure chamber that presses the orbiting scroll against the fixed scroll, in accordance with a suction pressure of the gaseous refrigerant drawn into the compression chamber, a discharge pressure of the gaseous refrigerant discharged from the compression chamber, and an injection pressure of the gaseous refrigerant injected into the compression chamber.

2. The scroll compressor according to claim 1, wherein the back pressure control valve adjusts the pressure in the back pressure chamber by causing a valve body that is biased in a valve closing direction by an elastic body and by the pressure in the back pressure chamber, to move in a valve opening direction by means of the suction pressure, the discharge pressure and the injection pressure, so as to change a flow rate of a lubricant supplied to the back pressure chamber, the lubricant having been separated from the gaseous refrigerant compressed in the compression chamber.

3. The scroll compressor according to claim 2, wherein the back pressure control valve is disposed in a passage through which the lubricant is supplied to the back pressure chamber.

4. The scroll compressor according to claim 1, wherein the back pressure control valve adjusts the pressure in the back pressure chamber by causing a valve body that is biased in a valve opening direction by an elastic body and by the pressure in the back pressure chamber, to move in a valve closing direction by means of the suction pressure, the discharge pressure and the injection pressure, so as to change a flow rate of a lubricant supplied to the back pressure chamber, the lubricant having been separated from the gaseous refrigerant compressed in the compression chamber.

5. The scroll compressor according to claim 4, wherein the back pressure control valve is disposed in a passage through which the lubricant is discharged from the back pressure chamber.

6. The scroll compressor according to claim 1, wherein the back pressure control valve further comprises an electromagnetic actuator that moves the valve body, and a control unit that electronically controls the electromagnetic actuator, wherein the control unit controls the electromagnetic actuator so that the pressure in the back pressure chamber becomes a target pressure set in accordance with the suction pressure, the discharge pressure and the injection pressure.

7. The scroll compressor according to claim 6, wherein the control unit calculates a target pressure in accordance with a revolution speed of the scroll unit as well as the suction pressure, the discharge pressure and the injection pressure.

* * * * *